US012727648B2

(12) United States Patent
Nakaya et al.

(10) Patent No.: US 12,727,648 B2
(45) Date of Patent: Sep. 8, 2026

(54) SHOE FIT EVALUATION DEVICE AND SHOE FIT EVALUATION METHOD

(71) Applicant: ASICS CORPORATION, Hyogo (JP)

(72) Inventors: Mai Nakaya, Hyogo (JP); Hiroyuki Kusumi, Hyogo (JP); Masayuki Tsutsui, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 366 days.

(21) Appl. No.: 18/378,608

(22) Filed: Oct. 10, 2023

(65) Prior Publication Data

US 2024/0115010 A1 Apr. 11, 2024

(30) Foreign Application Priority Data

Oct. 11, 2022 (JP) ..... 2022-162919
Jun. 8, 2023 (JP) ..... 2023-094815

(51) Int. Cl.
*A43D 1/02* (2006.01)

(52) U.S. Cl.
CPC ..... *A43D 1/027* (2013.01)

(58) Field of Classification Search
CPC ..... A43D 1/02; A43D 1/027; A43D 1/04
USPC ..... 33/3 R, 6
See application file for complete search history.

(56) References Cited

U.S. PATENT DOCUMENTS

| | | | | |
|---|---|---|---|---|
| 3,696,456 | A * | 10/1972 | Dunham | A43D 3/02 12/146 L |
| 6,741,728 | B1 | 5/2004 | Genest | |
| 7,107,235 | B2 * | 9/2006 | Lyden | A43B 23/028 36/38 |
| 9,648,926 | B2 * | 5/2017 | Marks | G06Q 30/0631 |
| 2017/0053335 | A1 | 2/2017 | Hanscom | |
| 2022/0083701 | A1 * | 3/2022 | Krabbe | G06F 30/10 |
| 2023/0404216 | A1 * | 12/2023 | Schmid | A43B 17/14 |
| 2024/0268524 | A1 * | 8/2024 | Soekawan | A43D 1/027 |

FOREIGN PATENT DOCUMENTS

| | | |
|---|---|---|
| JP | 2005169015 A | 6/2005 |
| WO | 2017025779 A1 | 2/2017 |
| WO | 2018007384 A1 | 1/2018 |

OTHER PUBLICATIONS

European Search Report issued Feb. 21, 2024 in corresponding European Application No. 23202398.6.

* cited by examiner

*Primary Examiner* — George B Bennett
(74) *Attorney, Agent, or Firm* — Spencer Fane, LLP

(57) ABSTRACT

In a shoe fit evaluation system, a dimensional difference calculator calculates a part dimensional difference, which is a difference between a measurement value of a foot part dimension and a last part dimension corresponding to the foot part, by performing a certain adjustment for the part. An evaluation processor calculates a last matching rate based on the part dimensional difference. An outputter outputs information regarding the last matching rate. The dimensional difference calculator calculates the part dimensional difference by performing, as the certain adjustment, subtraction of an allowance for specific stretch properties of each shoe part.

18 Claims, 13 Drawing Sheets

SHOE FIT EVALUATION DEVICE AND SHOE FIT EVALUATION METHOD

CROSS-REFERENCE TO RELATED APPLICATION

This application claims priority to Japanese Application No. 2022-162919, filed Oct. 11, 2022 and Japanese Application No. 2023-094815, filed Jun. 8, 2023, the contents of which are hereby incorporated by reference.

BACKGROUND

Technical Field

The present disclosure relates to a shoe fit evaluation device and a shoe fit evaluation method. In particular, the present disclosure relates to a technology for evaluating the fit of a shoe based on measurement values of a foot shape.

Background Information

There is a known technology of measuring a three-dimensional foot shape of a person who is considering purchasing shoes and using the measurement values to analyze whether or not the foot shape fits a shoe.

In Japanese Unexamined Patent Application Publication No. 2005-169015 and U.S. Patent Application Publication No. 2017/0053335, the foot shape of a subject is compared to a last by comparison with the dimensions of the last.

SUMMARY

However, it has been determined that the related arts do not disclose a specific method for comparing a foot shape and a last. In general, information on lasts is information to be kept confidential for shoe manufacturers, in which their techniques and know-how are concentrated. Accordingly, information such as the exact dimensions of a last and the design concept, materials, characteristics, and the like of each shoe can only be known by the manufacturer of the shoe. Therefore, even though the comparison between a foot shape and a last is theoretically possible, in reality, it is hard to say that there have been provided means of comparison and fit analysis in which the design concepts and characteristics of shoes and lasts are fully reflected.

Meanwhile, a store such as a shoe store may be staffed with a professional, also called a shoe fitter, who can select shoes that fit a customer's feet, with a wealth of knowledge and skills. Therefore, there has been desired development of technology for selecting shoes more easily and satisfyingly as if a shoe fitter did, without such expertise or skills.

The present disclosure has been made in view of such a situation, and a purpose thereof is to provide a technology for improving accuracy of selecting a shoe that fits a foot.

In response to the above issue, a shoe fit evaluation device according to one embodiment of the present disclosure includes: a measurement value acquirer that acquires measurement values of multiple foot part dimensions, which are dimensions of multiple foot parts including at least a foot length, as foot shape dimension information that defines a foot shape of a measurement subject; a last storage that stores, for each of multiple types of lasts, multiple last part dimensions, which are dimensions of last parts corresponding to multiple foot parts including at least the foot length, as last dimension information that defines a last; a dimensional difference calculator that calculates a part dimensional difference, which is a difference between a measurement value of a foot part dimension and a last part dimension corresponding to the foot part, by performing a predetermined adjustment for the part; an evaluation processor that calculates a last matching rate based on the part dimensional difference; and an outputter that outputs information regarding the last matching rate.

Another embodiment of the present disclosure relates to a shoe fit evaluation method. The method includes: acquiring measurement values of multiple foot part dimensions, which are dimensions of multiple foot parts including at least a foot length, as foot shape dimension information that defines a foot shape of a measurement subject; retrieving, from a predetermined storage means or device (storage), multiple last part dimensions, which are dimensions of last parts corresponding to multiple foot parts including at least the foot length, as last dimension information that defines a last; calculating a part dimensional difference, which is a difference between a measurement value of a foot part dimension and a last part dimension corresponding to the foot part, by performing a predetermined adjustment for the part; calculating a last matching rate based on the part dimensional difference; and outputting information regarding the last matching rate.

BRIEF DESCRIPTION OF THE DRAWINGS

Embodiments will now be described, by way of example only, with reference to the accompanying drawings which are meant to be exemplary, not limiting, and wherein like elements are numbered alike in several FIGURES, in which.

DETAILED DESCRIPTION

Figure 1:
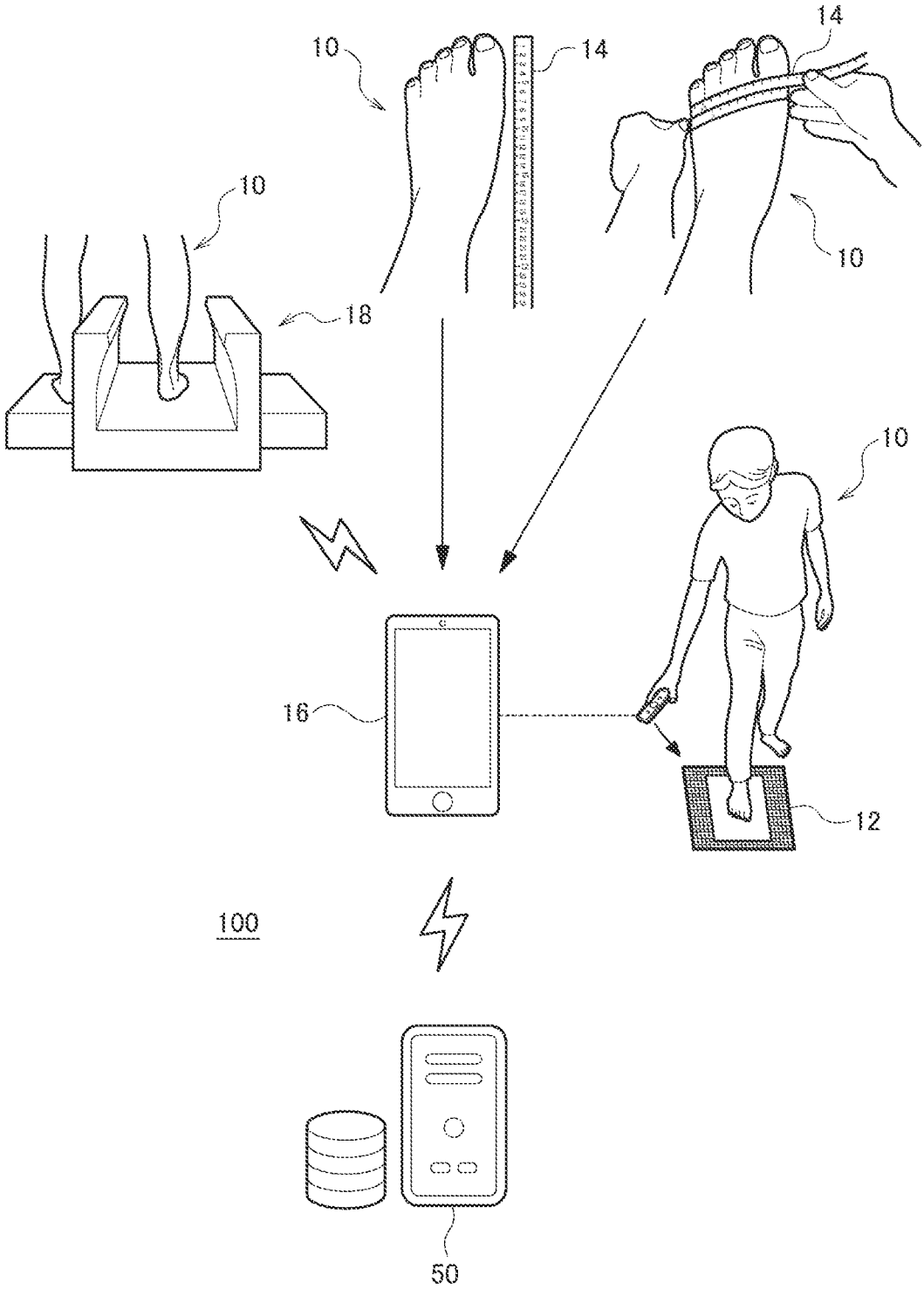
FIG. 1 illustrates a basic configuration of a shoe fit evaluation system.

The disclosure will now be described by reference to the embodiments. This does not intend to limit the scope of the present invention, but to exemplify the invention.

In the following, the present disclosure will be described based on embodiments with reference to each drawing. In the embodiments and modifications, like reference characters denote like or corresponding constituting elements, and the repetitive description will be omitted as appropriate.

First Embodiment

FIG. 1 illustrates a basic configuration of a shoe fit evaluation system 100. The shoe fit evaluation system 100 mainly includes an information terminal 16 and a shoe fit evaluation server 50. The "shoes" herein mainly mean running shoes or walking shoes but can also include other types of shoes. A measurement subject 10 scans his or her foot shape using a three-dimensional foot shape measuring device 18 installed at a shoe store. Alternatively, the measurement subject 10 can place his or her foot on a measurement mat 12 and scan his or her own foot shape by capturing an image of the foot with a camera function of the information terminal 16 and through measurement with a foot shape measurement application. Alternatively, the foot length and the ball girth of the measurement subject 10 can be manually measured using a measuring instrument such as a tape measure 14, and the measurement values can be entered into the information terminal 16. The three-dimensional foot shape measuring device 18 acquires three-dimensional data related to the foot shape of the measurement subject 10 by laser measurement. The "foot shape" as used herein is a three-dimensional model that virtually reproduces a three-dimensional shape of a foot of the measurement subject 10. The information terminal 16 can generate the foot shape of the measurement subject 10 by a three-dimensional scanner function using a technology such as light detection and ranging (LiDAR) or through image synthesis processing such as photogrammetry.

The shoe fit evaluation system 100 can further include the measurement mat 12 and the three-dimensional foot shape measuring device 18. The information terminal 16 can be operated by the measurement subject 10 himself or herself as a user, or the three-dimensional foot shape measuring device 18 or the information terminal 16 can be used by a person other than the measurement subject 10, such as a salesperson of a shoe store, to perform the foot shape scanning. Therefore, the information terminal 16 can be a terminal owned by a shoe store where the three-dimensional foot shape measuring device 18 is installed or can be a terminal owned by the measurement subject 10 himself or herself.

The measurement values as the result of three-dimensional measurement of a foot shape scanned by the three-dimensional foot shape measuring device 18 or the information terminal 16 are transmitted from the information terminal 16 to the shoe fit evaluation server 50. The "shoe fit evaluation device" in the claims can mean the entire shoe fit evaluation system 100 or can mean the shoe fit evaluation server 50. In the present embodiment, the shoe fit evaluation server 50 substantially corresponds to the "shoe fit evaluation device" because many of the characteristic functions included in the "shoe fit evaluation device" in the claims are implemented such as to be included in the shoe fit evaluation server 50. The characteristic functions of the "shoe fit evaluation device" can also be distributed between the information terminal 16 and the shoe fit evaluation server 50 or can also be implemented such that many of them are included in the information terminal 16.

The shoe fit evaluation server 50 is a server computer connected to multiple information terminals 16 via a network line, such as the Internet or a local area network (LAN), and a communication means or device (communicator), such as wireless communication. The shoe fit evaluation server 50 can be constituted by a single server computer or can be constituted by a combination of multiple server computers. The information terminal 16 can be a mobile information terminal, such as a smartphone or a tablet terminal, or can be a personal computer.

Figure 2A:
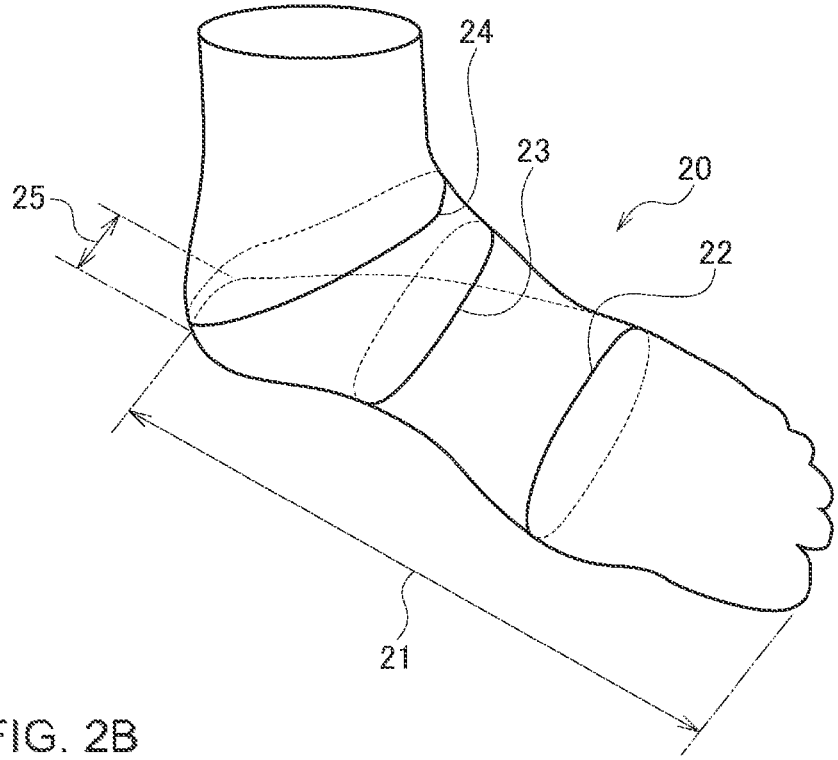
FIGS. 2A and 2B schematically illustrate correspondence relationships between parts in a foot shape of a measurement subject and parts in a last.
Figure 2B:
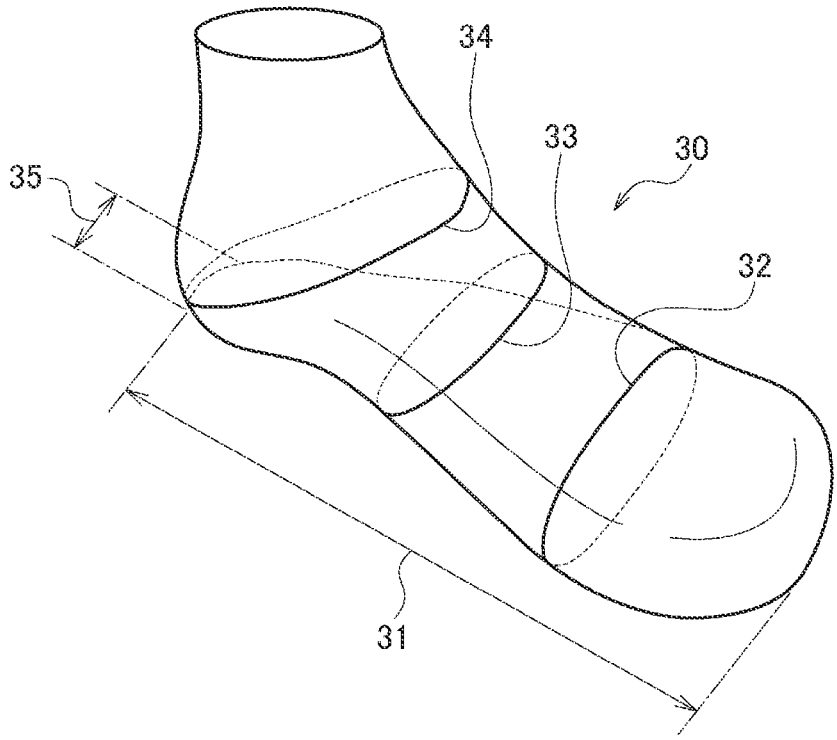

FIG. 2 schematically illustrate correspondence relationships between parts in a foot shape of a measurement subject and parts in a last. In the present embodiment, the fit of a foot shape to a shoe as an evaluation target is evaluated based on dimensional differences between multiple foot parts in a foot shape and the corresponding multiple foot parts in a last. FIG. 2A schematically illustrates a three-dimensional model of a foot shape. FIG. 2B schematically illustrates a three-dimensional model of a last. The multiple foot parts herein mean the foot length, ball girth, heel width, instep girth, and short heel girth. In the present embodiment, the fit of a foot shape to a shoe is evaluated with reference to the dimensional differences in the foot length and the ball girth and a measurement value of the heel width. In a modification, however, a combination of one or more of the ball girth, heel width, instep girth, and short heel girth and the foot length can be referred to for the evaluation of the fit. In the following, with reference to FIGS. 2, multiple foot parts including the foot length, ball girth, heel width, instep girth, and short heel girth will be described.

A foot shape 20 is a three-dimensional model obtained by scanning the shape of a foot of the measurement subject 10 with the three-dimensional foot shape measuring device 18 or information terminal 16 and virtually reproducing the shape. However, the foot shape 20 does not necessarily faithfully reproduce the foot shape, especially the shape near the toes, of the measurement subject 10 and is intentionally deformed so as to be easily compared with a last 30. Based on the three-dimensional model of the foot shape thus generated, a foot shape foot length 21, a foot shape ball girth 22, a foot shape instep girth 23, a foot shape short heel girth 24, and a foot shape heel width 25 can be measured. The foot shape foot length 21, foot shape ball girth 22, foot shape instep girth 23, foot shape short heel girth 24, and foot shape heel width 25 are parts corresponding respectively to the foot length, ball girth, instep girth, short heel girth, and heel width of the foot of the measurement subject 10.

A last 30 is a three-dimensional model that virtually reproduces one of lasts of multiple types of shoes prepared in advance as options for shoes to be recommended. For shoes, multiple types of products are prepared, and even a single type of product model can be available in sizes corresponding to multiple foot lengths and multiple foot widths. Further, different shapes can be prepared for men and women. For each of the many types of shoes, a different last is used. A last is a mold assumed to be an ideal foot shape for each shoe model and is actually used as a mold in the shoe manufacturing process. In the shoe manufacturing process, a shoe is manufactured such that the upper and sole are bonded together such as to wrap around a last before the last is taken out. In the shape and size of the last for each shoe model or in the stretch properties and allowance of the shoe set for each part of the last, the design concept for the product and know-how is reflected, so that such information is not usually disclosed outside the shoe manufacturer. A reference value for fit judgment based on such design concept and know-how is set in advance in the shoe fit evaluation server 50, which will be described later.

In the three-dimensional model of a last, values indicating a last foot length 31, a last ball girth 32, a last instep girth 33, a last short heel girth 34, and a last heel width 35 are prepared in advance. The last foot length 31, last ball girth 32, last instep girth 33, last short heel girth 34, and last heel width 35 are parts corresponding respectively to the foot shape foot length 21, foot shape ball girth 22, foot shape instep girth 23, foot shape short heel girth 24, and foot shape heel width 25. Therefore, a foot length dimensional difference is calculated between the foot shape foot length 21 and the last foot length 31, and a ball girth dimensional difference is calculated between the foot shape ball girth 22 and the last ball girth 32. Also, an instep girth dimensional difference can be calculated between the foot shape instep girth 23 and the last instep girth 33, a short heel girth dimensional difference can be calculated between the foot shape short heel girth 24 and the last short heel girth 34, and a heel width dimensional difference can be calculated between the foot shape heel width 25 and the last heel width 35.

Figure 3:
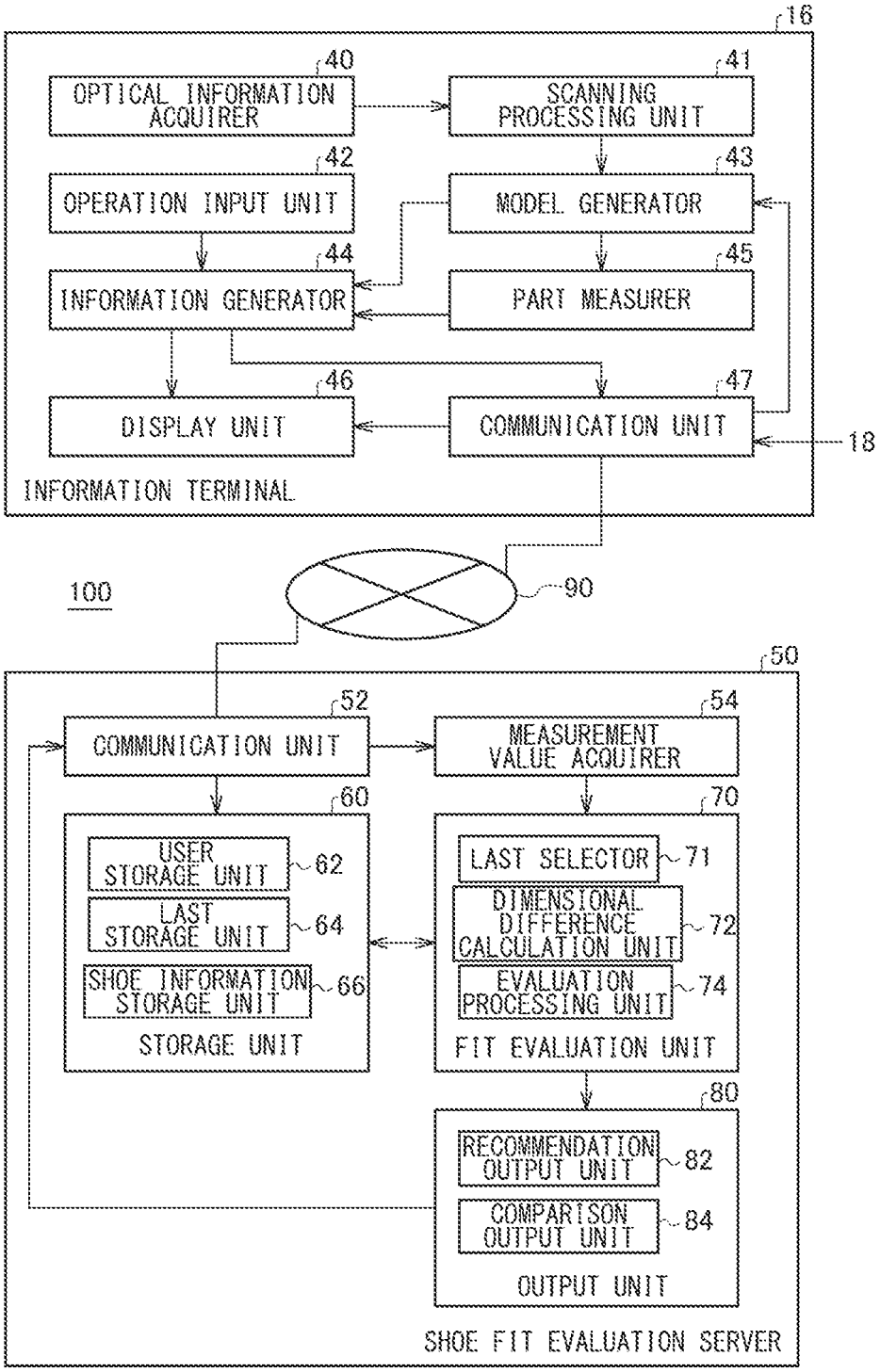
FIG. 3 is a functional block diagram that shows each configuration in the shoe fit evaluation system.

FIG. 3 is a functional block diagram that shows each configuration in the shoe fit evaluation system 100. The shoe fit evaluation system 100 in the present embodiment is constituted by the information terminal 16 and the shoe fit evaluation server 50. The shoe fit evaluation system ltk) can be implemented by various hardware configurations and software configurations. For example, the shoe fit evaluation system 100 can be constituted only by the shoe fit evaluation server 50 or can be constituted only by the information terminal 16.

With regard to each of the information terminal 16 and the shoe fit evaluation server 50, FIG. 3 shows functional blocks implemented by coordination of various hardware configurations and software configurations. Therefore, it will be understood by those skilled in the art that these functional blocks can be implemented in a variety of forms by hardware only, software only, or a combination thereof. The information terminal 16 is constituted by a combination of hardware, such as a camera module, range sensor, microprocessor, touch panel, memory, and communication module. The information terminal 16 can be a general-purpose information terminal, such as a smartphone or tablet terminal, prepared by the measurement subject 10 or a shoe store. By equipping the information terminal 16 with a program having the following functions or by accessing a website provided by the shoe fit evaluation server 50 via a web browser, the information terminal 16 substantially performs the following functions by cooperation between software and hardware. The information terminal 16 includes, as its functions, an optical information acquirer 40, a scanning processing unit 41, an operation input unit 42, a model generator 43, an information generator 44, a part measurer 45, a display unit 46, and a communication unit 47.

When a three-dimensional model is generated using a LiDAR technology, the optical information acquirer 40 is constituted by a LiDAR sensor in terms of hardware. In this case, the optical information acquirer 40 detects laser light, and the scanning processing unit 41 scans a three-dimensional shape of a foot of the measurement subject 10 by measuring the distance to the object based on the information acquired from the optical information acquirer 40. Based on the information obtained through the scanning by the scanning processing unit 41, the model generator 43 generates a three-dimensional model of the foot shape.

When a three-dimensional model is generated using a photogrammetry technology, the optical information acquirer 40 is constituted by a camera module in terms of hardware. In this case, the optical information acquirer 40 captures an image of a foot of the measurement subject 10 from the surroundings, and the scanning processing unit 41 scans a three-dimensional shape of the foot of the measurement subject 10 by acquiring a moving image or a number of still images as images of the foot. Based on the information obtained through the scanning by the scanning processing unit 41, the model generator 43 generates a three-dimensional model of the foot shape.

When a three-dimensional model is generated using the three-dimensional foot shape measuring device 18, the model generator 43 acquires information obtained through scanning by the three-dimensional foot shape measuring device 18 via the communication unit 47 and generates a three-dimensional model of the foot shape based on the information thus acquired.

The part measurer 45 measures the foot shape foot length 21, foot shape ball girth 22, foot shape instep girth 23, foot shape short heel girth 24, and foot shape heel width 25 in the three-dimensional model generated by the model generator 43. The information generator 44 generates screen display contents for displaying the three-dimensional model generated by the model generator 43 and the measurement values measured by the part measurer 45 on the screen of the information terminal 16. The information generator 44 also generates information on the three-dimensional model and the measurement values, identification information and attribute information for identifying the measurement subject 10, information for identifying the shoe preferences and wishes of the measurement subject 10, and the like and transmits such information to the shoe fit evaluation server 50 via the communication unit 47. The display unit 46 displays the display contents generated by the information generator 44 and display contents received from the shoe fit evaluation server 50, on the screen of the information terminal 16.

The shoe fit evaluation server 50 is constituted by a combination of hardware, such as a microprocessor, memory, display, and communication module. The shoe fit evaluation server 50 can be a server computer constructed and managed by a shoe manufacturer. On the shoe fit evaluation server 50, a program having the following functions runs. The shoe fit evaluation server 50 includes, as its functions, a communication unit 52, a measurement value acquirer 54, a storage unit 60, a fit evaluation unit 70, and an output unit 80. The communication unit 47 of the information terminal 16 and the communication unit 52 of the shoe fit evaluation server 50 are connected via a network 90.

The measurement value acquirer 54 acquires, from the information terminal 16 via the communication unit 52, the measurement values of multiple foot part dimensions, which are dimensions of multiple foot parts including at least the foot length, as foot shape dimension information that defines a foot shape of the measurement subject 10. Although the measurement value acquirer 54 of the present embodiment acquires the measurement values of the foot length, ball girth, and heel width, in a modification, the measurement values of any one or more or all of the ball girth, instep girth, short heel girth, and heel width in combination with the foot length can be acquired.

The storage unit 60 includes a user storage unit 62, a last storage unit 64, and a shoe information storage unit 66. The user storage unit 62 stores the identification information and attribute information for identifying the measurement subject 10, transmitted from the information terminal 16. The last storage unit 64 stores, for each of multiple types of lasts, multiple last part dimensions, which are dimensions of last parts corresponding to multiple foot parts including at least the foot length, as last dimension information that defines a last. Although the last storage unit 64 of the present embodiment stores, as the multiple last part dimensions, the dimensions of the last foot length and the last ball girth for each last, in a modification, the dimensions of any one or more or all of the last ball girth, last instep girth, last short heel girth, and last heel width in combination with the last foot length can be stored. The shoe information storage unit 66 stores information on multiple models and multiple sizes of shoes. The multiple models include men's models and women's models. The shoe sizes include multiple foot length sizes and multiple foot width sizes. The shoe information includes various adjustment values, which will be detailed later, set in advance for each last or each shoe.

The fit evaluation unit 70 includes a last selector 71, a dimensional difference calculation unit 72, and an evaluation processing unit 74. The last selector 71 selects, as an evaluation target, any one or more lasts from among multiple types of lasts stored in the last storage unit 64. For example, based on preference information and measurement values of foot dimensions entered by the operator of the information terminal 16, the last selector 71 selects one or more lasts as evaluation targets, from among lasts of shoes that can be worn with a foot of the foot dimensions and lasts of which sizes approximate the foot dimensions. In order to select the most suitable shoe for the foot of the measurement subject 10 from among a wide range of options, it is desirable that the last selector 71 selects multiple lasts as the evaluation targets. In a modification, instead of the multiple lasts selected in advance as the evaluation targets by the last selector 71, substantially all lasts stored in the last storage unit 64 can be set as the evaluation targets. In such a case, the dimensional difference calculation unit 72 and the evaluation processing unit 74 calculate a part dimensional difference and a last matching rate for each of all lasts as the evaluation targets. Conversely, in the present embodiment, in order to avoid the calculation of the part dimensional difference and the last matching rate for all lasts, the evaluation targets are narrowed down to some extent particularly based on the measurement values of the foot length and the ball girth and on the preferences and attributes of the measurement subject 10 before the part dimensional difference and the last matching rate are calculated, so as to reduce the calculation load. A dimensional difference between a last selected by the last selector 71 and a foot shape acquired by the measurement value acquirer 54 is calculated as follows.

The dimensional difference calculation unit 72 calculates a part dimensional difference, which is a difference between the measurement value of a foot part dimension and a last part dimension corresponding to the foot part, in which a predetermined adjustment for the part is performed. The evaluation processing unit 74 calculates the last matching rate based on the part dimensional difference. In the following, methods for calculating the part dimensional difference and the last matching rate will be detailed.

As described previously, the part dimensional difference in the present embodiment includes the dimensional difference between the measurement value of the foot length in a foot shape and the last foot length, and the dimensional difference between the measurement value of the ball girth in the foot shape and the last ball girth. In a modification, however, a combination of the part dimensional difference of at least one of the instep girth, short heel girth, or heel width and the part dimensional difference of the foot length can be used.

The "predetermined adjustment" includes the following four calculations. That is, in the calculation of the part dimensional difference, there are an adjustment to subtract an allowance for the specific stretch properties of each shoe part (Adjustment 1), an adjustment to calculate the part dimensional difference as the sum of the squares of part dimensional differences in which the specific weights of the respective parts are added (Adjustment 2), an adjustment to calculate the sum of the squares of part dimensional differences in which a first weight is added to the part dimensional difference of the foot length and a second weight, which is smaller than the first weight, is added to the part dimensional difference of a part other than the foot length (Adjustment 3), and an adjustment to use, as a measurement value of a foot part dimension, a value obtained by adding, to the actual measured value of the foot part dimension, an error correction depending on the measurement method (Adjustment 4). The method for calculating the last matching rate with these adjustments added is given by the following equation.

$$\text{Last matching rate}=100-\text{part dimensional difference}$$

The part dimensional difference as used herein is the sum of the squares of the foot length dimensional difference and the ball girth dimensional difference and is given by the following equation.

$$\text{Part dimensional difference}=\alpha\times\text{foot length score}+\beta\times\text{ball girth score}$$

The "foot length score" is a value obtained by squaring the foot length dimensional difference, and the "ball girth score" is a value obtained by squaring the ball girth dimensional difference. The foot length dimensional difference is the dimensional difference between the last foot length and the measurement value of the foot length, and the ball girth dimensional difference is the dimensional difference between the last ball girth and the measurement value of the ball girth. However, since each shoe part can have specific stretch properties, the foot length dimensional difference and the ball girth dimensional difference are calculated such that allowances for such stretch properties are subtracted (Adjustment 1). Therefore, the foot length score and the ball girth score are given by the following equations.

$$\text{Foot length score}=(\text{last foot length}-\text{foot length measurement value}-d1)\hat{}2$$

$$\text{Ball girth score}=(\text{last ball girth}-\text{ball girth measurement value}-d2)\hat{}2$$

The upper can be formed to have relatively low stretchability in the foot length directions of the shoe and can be formed to have relatively high stretchability in the ball girth directions of the shoe. For example, d1, which is an adjustment value in the foot length directions, can be set to a small value of 1 mm or less. Also, d2 can be set to a large value of several millimeters or more, which corresponds to 2-3% of the ball girth, so as to allow a wearer to select slightly tight shoes at least at the time of purchase, in anticipation of stretching and contracting to some extent in the ball girth directions, for example. Therefore, the values of d1 and d2 can be set so that d1<d2 holds. Also, each of d1 and d2 can be set to a negative value. Also, d1 and d2 can be set for each last, i.e., for each shoe model or size. Further, d1 and d2 can be set to pre-adjusted values so that the results are equivalent to those obtained when a shoe fitter selects shoes.

Lasts are not necessarily made to perfectly reproduce the shape of a human foot, and a last can be sometimes intentionally made to have a characteristic shape that differs from the shape of a human foot, for a design concept for enhancing the functionality of the shoe. Also, in many designs, a margin called "toe room" is provided as a toe space so as to prevent the toe from frequently coming into contact with an inner tip portion of the shoe during walking. In the case of shoes for trail runners who run on uneven ground or undulating road surfaces, a shoe with larger toe room than a normal shoe can be preferred to prevent frequent contact of the toe with the shoe. Also, the material or thickness of the upper can differ depending on the category or model of the shoe. Thus, since such differences based on the design concept and shoe characteristics can be considered in advance also for the part dimensional difference, d1 and d2 can be set as the adjustment values based on such design differences.

The part dimensional difference is calculated as the sum of the squares of part dimensional differences with weights α and β specific to the respective parts added (Adjustment 2). More specifically, the foot length score is multiplied by the weighting factor α, and the ball girth score is multiplied by the weighting factor β. When the fit of a shoe is measured, the foot length is considered to be the most influential factor among multiple foot parts. Therefore, also when the last matching rate is calculated, a relatively large weight is given in the evaluation of the foot length, and a relatively small weight is given in the evaluation of the ball girth (Adjustment 3). The weighting factor α can be set to 0.6 to 0.8, and the weighting factor β can be set to 0.4 to 0.2, which is smaller than the weighting factor α. For example, when the weighting factor α is set to 0.8, the weighting factor β is set to 0.2; when the weighting factor α is set to 0.6, the weighting factor β is set to 0.4. The weighting factors α and β are stored in the shoe information storage unit 66 and can be set to different values for each shoe model or size. Further, the weighting factors α and β can be set to pre-adjusted values so that the results are equivalent to those obtained when a shoe fitter selects shoes. As a modification, the instep girth score, short heel girth score, and heel width score can be further calculated based on the instep girth dimensional difference, short heel girth dimensional difference, and heel width dimensional difference, and the square value in each of these scores can be given a specific weight to calculate the part dimensional difference.

As a measurement value of each foot part, a value obtained by adding an error correction depending on the measurement method to the actual measured value of the foot part dimension is used (Adjustment 4). For example, when the last dimensions to be stored in the last storage unit 64 are designed to be obtained by manually measuring the foot part dimensions using a measuring instrument such as the tape measure 14, an error may occur between measurement by the three-dimensional foot shape measuring device 18 or the information terminal 16 by laser ranging and the manual measurement. For example, it is considered that the measurement values of laser ranging are slightly smaller. Therefore, when the measurement values are not manually measured, values obtained by adding an error correction of about 2 to 3 mm, for example, to each of the actual measured values of the foot length dimension and the ball girth dimension can be used as the measurement values of the foot part dimensions, in order to match the design concept of the last. Also, in the case of manual measurement, the error correction of the ball girth dimension can be made larger than the error correction of the foot length dimension, in order to reflect the feature by which, compared to the measurement of the foot length, the ball girth is likely to be smaller than the actual ball girth by being measured with the tape measure placed tighter.

When the ratio of the actual measured value of the heel width dimension to the actual measured value of the foot length dimension, which is referred to a heel width ratio, is greater than or equal to a predetermined ratio (e.g., around ¼), it is assumed that the upper limit of the ideal heel width of the last is exceeded, and the heel of the foot is less likely to fit properly in the heel portion of a shoe made with the last. In such a case, since the heel does not fit in the shoe, the foot will easily move forward during walking or the like, which can cause the shoe to feel tight because there is no room in the toe space. Therefore, when the heel width is a predetermined ratio or greater, a value obtained by adding a predetermined size up adjustment value (4 to 5 mm, for example) to the actual measured value of the foot length dimension can be used as the measurement value of the foot length dimension, for the purpose of recommending the shoe in the next size up. The error correction and the size up adjustment value are stored in the shoe information storage unit 66 and can be set to different values for each shoe model or size. Also, the error correction and the size up adjustment value can be set to pre-adjusted values so that the results are equivalent to those obtained when a shoe fitter selects shoes.

The evaluation processing unit 74 calculates the last matching rate for each of multiple types of lasts as the evaluation targets. The evaluation processing unit 74 selects at least one shoe corresponding to a last having a relatively high last matching rate, from among multiple shoe options. Thus, by calculating the last matching rate based on the part dimensional difference obtained as a result of comparison between the measurement values of foot parts and last parts and by selecting the most suitable shoe based on the last matching rate, a shoe with an inner shape that has a high degree of conformity with the foot shape can be selected. Since the last matching rate is calculated based on the last part dimensions and numerical values in which characteristics of each shoe or each last are accurately reflected, the accuracy of selecting a shoe that fits a foot can be improved. Also, since various adjustment values can be set for each shoe or each last, a shoe selection method in which the expertise and know-how of shoe fitters is reflected can be reproduced more faithfully.

The output unit 80 transmits information regarding the last matching rate to the information terminal 16 via the communication unit 52 so as to display shoe recommendation information including the last matching rate on the screen of the information terminal 16. The output unit 80 includes a recommendation output unit 82 and a comparison output unit 84. The recommendation output unit 82 outputs, as recommendation information, information that indicates a shoe selected by the evaluation processing unit 74 and the last matching rate of the last of the shoe. The comparison output unit 84 outputs information that visually indicates a comparison result between a last part dimension of a shoe selected by the evaluation processing unit 74 and a foot part dimension. Examples of screen display of the recommendation information and comparison result will be detailed later.

Figure 4:
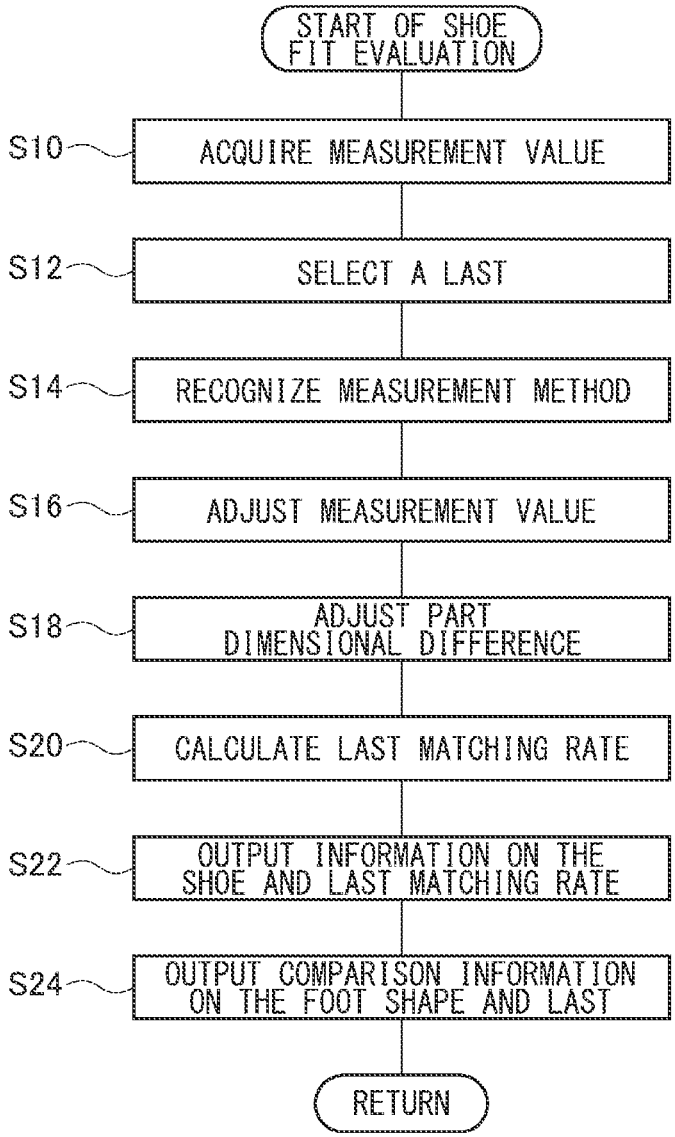
FIG. 4 is a flowchart that shows the process of shoe fit evaluation processing.

FIG. 4 is a flowchart that shows the process of shoe fit evaluation processing. When the shoe fit evaluation processing is started, the measurement value acquirer 54 acquires measurement values of foot part dimensions (S10), and the last selector 71 selects a last as an evaluation target (S12). The dimensional difference calculation unit 72 recognizes the measurement method used for the measurement of the foot part dimensions (S14) and adjusts the measurement values of the foot part dimensions for error correction depending on the measurement method (S16). The dimensional difference calculation unit 72 adjusts the part dimensional difference according to the characteristics of each part (S18), and the evaluation processing unit 74 calculates the last matching rate based on the part dimensional difference (S20). The recommendation output unit 82 outputs information on the shoe and the last matching rate (S22), the comparison output unit 84 outputs comparison information on the foot shape and the last (S24), and the shoe fit evaluation processing is terminated. The processes from S10 to S24 can be performed in various orders, and the order of S10 to S24 in the flowchart of FIG. 4 is merely an order determined for convenience. Also, the process from the last selection processing at S12 to the output processing at S22 and S24 can be repeated while the shoe as the evaluation target is replaced, until the most suitable shoe for the measurement subject 10 is found.

Figure 5:
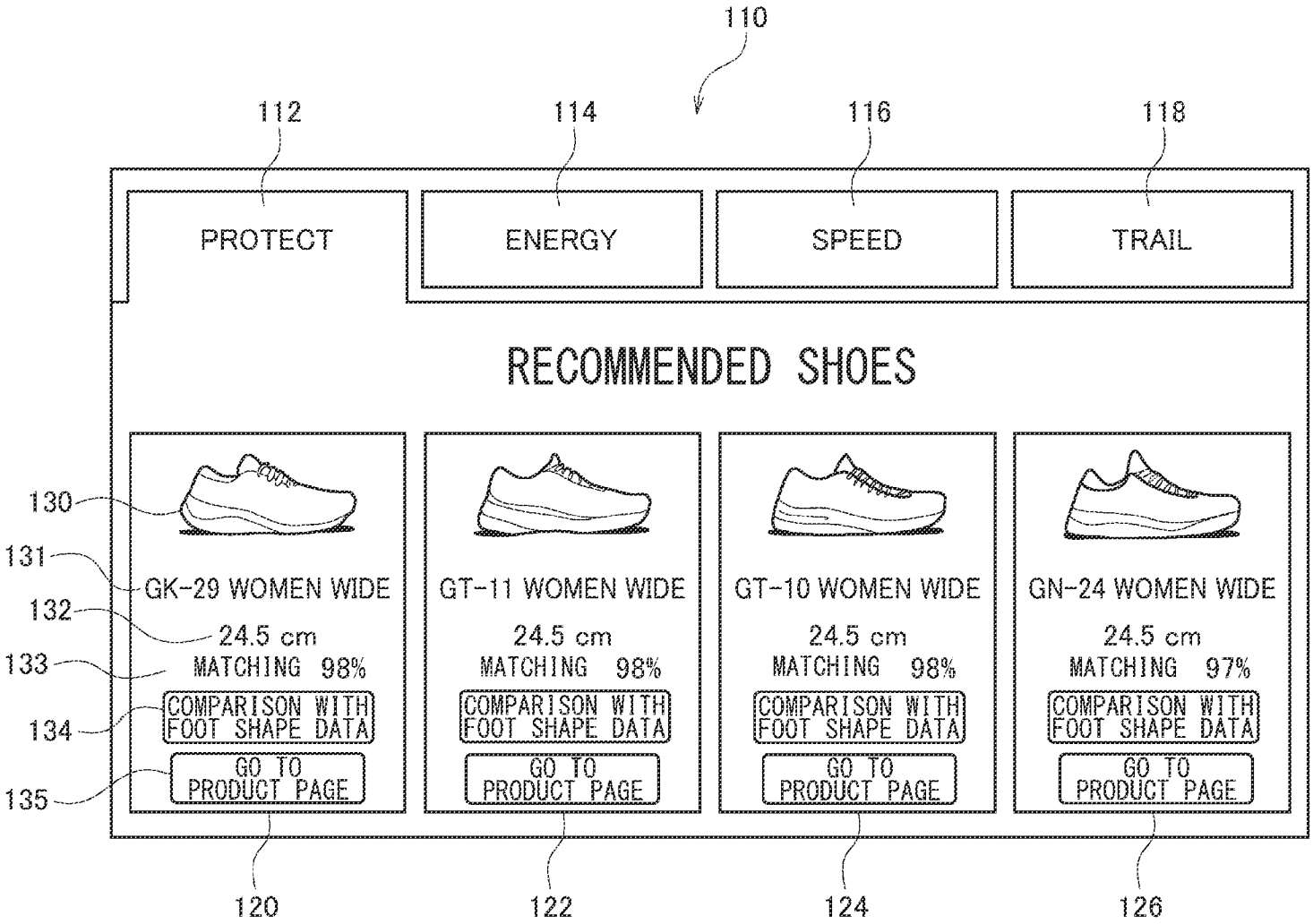
FIG. 5 illustrates a screen example for shoe recommendation information.

FIG. 5 illustrates a screen example for shoe recommendation information. On a screen 110 displayed on the information terminal 16, recommendation information generated by the recommendation output unit 82 based on a shoe selected by the evaluation processing unit 74 and the last matching rate is displayed. The screen 110 is mainly constituted by a first tab screen 112, a second tab screen 114, a third tab screen 116, and a fourth tab screen 118, and a tab screen selected by the operator from among the first tab screen 112, second tab screen 114, third tab screen 116, and fourth tab screen 118 is displayed. For example, the category "PROTECT" on the first tab screen 112 corresponds to shoes for a wide range of runners, from beginners aiming to complete a marathon to everyday runners. The category "ENERGY" on the second tab screen 114 corresponds to shoes for runners of various levels who want to run longer and comfortably. The category "SPEED" on the third tab screen 116 corresponds to shoes for runners who pursue speed, such as athletes and advanced marathon runners. The category "TRAIL" on the fourth tab screen 118 corresponds to shoes for trail runners who run on uneven ground or undulating road surfaces. By selecting one of the tab screens, the operator can select a preferred shoe category.

On the screen 110 shown in FIG. 5, pieces of information for recommending four types of shoes as the shoes corresponding to the category "PROTECT" are displayed respectively in a first recommendation column 120, a second recommendation column 122, a third recommendation column 124, and a fourth recommendation column 126. For example, in the first recommendation column 120, a shoe image 130, a product name 131, size information 132, a last matching rate 133, a comparison button 134, and a detail button 135 are displayed. The shoe image 130 visually shows the appearance of a recommended shoe. The product name 131 is a model name of the shoe, such as "GK-29 WOMEN WIDE", and includes an identification name to distinguish whether the model is for men or women and which foot width model it is. The size information 132 is a character string indicating the last foot length, such as "24.5 cm". However, since the length unit used for a product model varies, such as centimeters and inches, it is not required that the length is exactly the same as the actual last foot length.

As the last matching rate 133, the numerical value of the last matching rate calculated by the evaluation processing unit 74 is displayed in the form of a character string, such as "matching 98%". The comparison button 134 is a link button to a comparison page for comparing a foot shape and a last, and, when the operator presses the comparison button 134, the screen switches to the comparison page between the foot shape and the last. The detail button 135 is a link button to a product introduction page for introducing the details of the shoe model recommended in the first recommendation column 120, and, when the operator presses the detail button 135, the screen switches to the product introduction page.

As in the first recommendation column 120, also in each of the second recommendation column 122, third recommendation column 124, and fourth recommendation column 126, the shoe image, product name, size information, last matching rate, comparison button, and detail button are displayed. Thus, the last matching rate for each recommended shoe model is presented, so that the user can compare the products with each other and consider a purchase based thereon.

Figure 6:
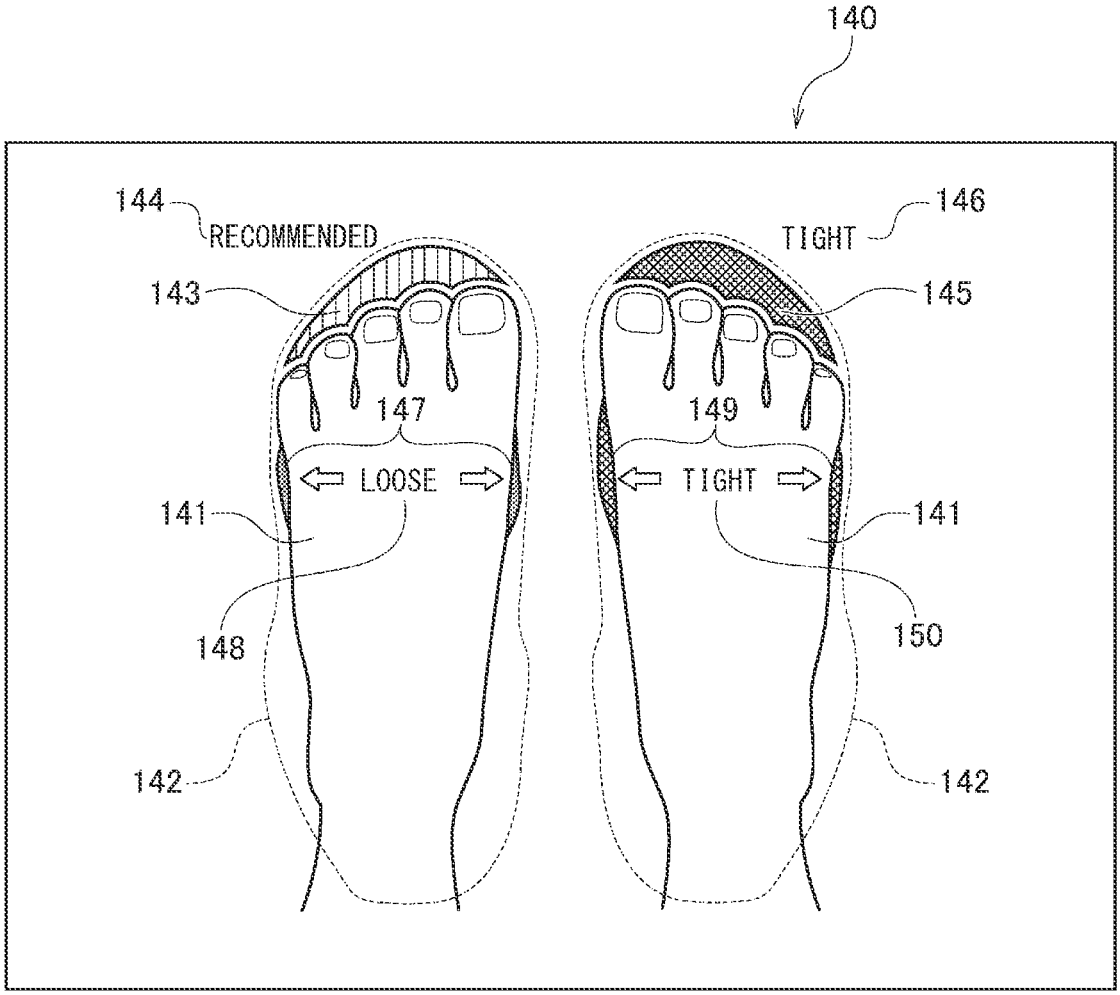
FIG. 6 illustrates a first example of a comparison page for a foot shape and a last.

FIG. 6 illustrates a first example of a comparison page for a foot shape and a last. On a screen 140 displayed on the information terminal 16, left and right foot shape images 141 are displayed, and left and right shoe images 142 are also displayed such as to overlap the foot shape images 141. In FIG. 6, the outline of each shoe is indicated as a shoe image 142 with a dotted line, for the sake of convenience. However, in order to make a difference in positional relationship or size between a foot shape image 141 and a shoe image 142 clearer, an actual shoe image can be displayed in a translucent manner and superimposed on the foot shape image 141.

A left foot length difference area 143 is an area displayed to indicate a margin in the foot length directions of the left foot, and a pattern or color indicating that the left foot length dimension difference is appropriate is applied to the area. As a left foot length fit display 144, which indicates the magnitude of the left foot length dimension difference in words, the character string of "RECOMMENDED" is displayed to indicate that the left foot length dimension difference is appropriate.

A right foot length difference area 145 is an area displayed to indicate a margin in the foot length directions of the right foot, and a pattern or color indicating that the right foot length dimension difference is too small is applied to the area. As a right foot length fit display 146, which indicates the magnitude of the right foot length dimension difference in words, the character string of "TIGHT" is displayed to indicate that the right foot length dimension difference is too small.

A left ball girth difference area 147 is an area displayed to indicate a margin in the ball girth directions of the left foot, and a pattern or color indicating that the left ball girth dimension difference is slightly large is applied to the area. As a left ball girth fit display 148, which indicates the magnitude of the left ball girth dimension difference in words, the character string of "LOOSE" is displayed to indicate that the left ball girth dimension difference is slightly large.

A right ball girth difference area 149 is an area displayed to indicate a margin in the ball girth directions of the right foot, and a pattern or color indicating that the right ball girth dimension difference is too small is applied to the area. As a right ball girth fit display 150, which indicates the magnitude of the right ball girth dimension difference in words, the character string of "TIGHT" is displayed to indicate that the right ball girth dimension difference is too small.

As described above, by visually expressing differences between a foot shape and a last with words, colors, patterns, and the like, whether or not the shoe fits the foot can be intuitively grasped by the measurement subject 10.

Figure 7:
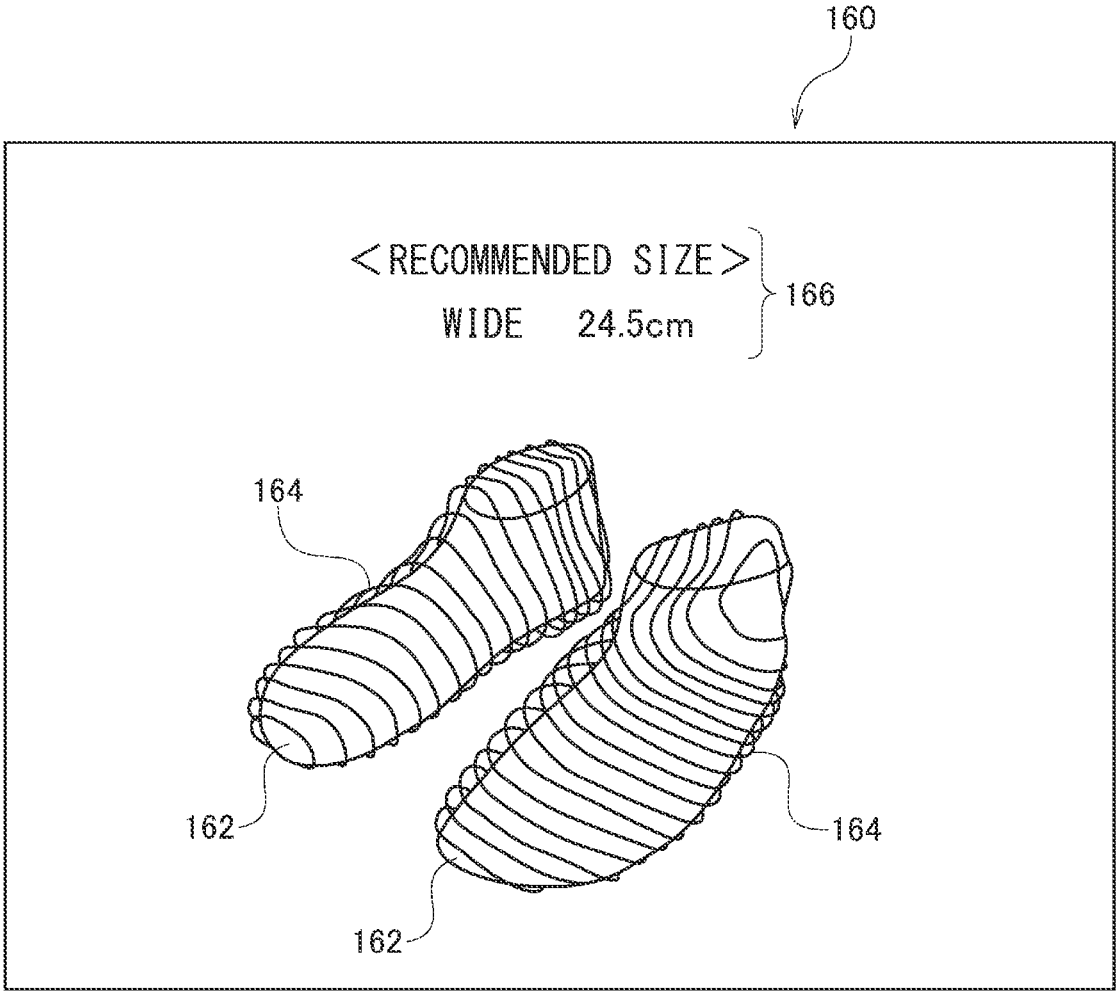
FIG. 7 illustrates a second example of a comparison page for a foot shape and a last.

FIG. 7 illustrates a second example of a comparison page for a foot shape and a last. On a screen 160 displayed on the information terminal 16, left and right foot shape images 162 are displayed in the form of three-dimensional models, and last images 164 are also displayed in the form of three-dimensional wire frames around the foot shape three-dimensional models. In other words, the foot shapes of the measurement subject 10 are displayed three-dimensionally as if they were wearing recommended shoes. As recommendation information 166, a character string indicating the size of the foot length, such as "24.5 cm", and a character string indicating the foot width type, such as "WIDE", are displayed. Also, the numerical value of the last matching rate can be further displayed.

As described above, by visually expressing a difference or the fit between a foot shape and a last in three-dimensional space, whether or not the shoe fits the foot can be intuitively grasped by the measurement subject 10.

Second Embodiment

The second embodiment differs from the first embodiment in that the fit is calculated with further reference to the instep girth, toe shape, and short heel girth, besides the measurement values of the foot length, ball girth, and heel width, as the reference values used for evaluation of the fit of a foot shape to a shoe. Also, in the second embodiment, the fit of a foot shape is calculated for a shoe selected by the user, which differs from the first embodiment in which a shoe that fits a foot shape is extracted and presented to the user. In the following, description will be given mainly for the differences from the first embodiment, and the description of features in common will be omitted.

Figure 8:
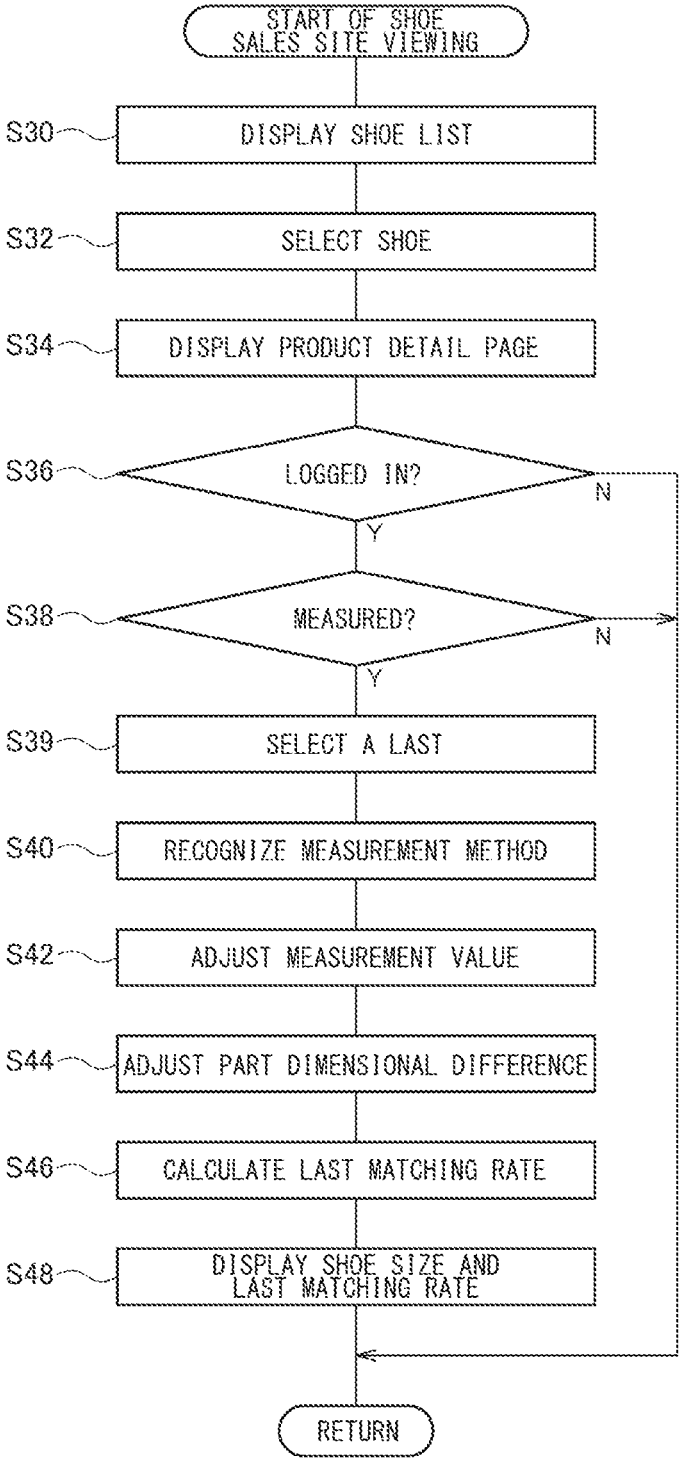
FIG. 8 is a flowchart that shows the process of shoe fit evaluation processing in a second embodiment.

FIG. 8 is a flowchart that shows the process of the shoe fit evaluation processing in the second embodiment. In the second embodiment, measurement values of a foot shape of the measurement subject 10 acquired by the three-dimensional foot shape measuring device 18 or the like are transmitted to the shoe fit evaluation server 50 and stored in association with identification information of the measurement subject 10 in the shoe fit evaluation server 50 in advance. In a modification, measurement values of a foot shape of the measurement subject 10 may not be acquired in advance by the three-dimensional foot shape measuring device 18 or the like. In that case, the user himself or herself can enter information on the foot length and the ball girth as the measurement values of the foot shape by text entry or the like, and the information thus entered can be stored as the measurement values of the foot shape in association with the user's identification information in the shoe fit evaluation server 50. Alternatively, the measurement values of a foot shape or information on the foot length and the ball girth entered by the user himself or herself may not be stored in association with the identification information in the shoe fit evaluation server 50; when a shoe size suitable for the user's foot and the last matching rate thereof are calculated, the user can enter the information on the foot length and the ball girth, and the information can be used for the calculation.

When a user accesses an online shoe sales site, a list of shoes for sale is displayed (S30). When the user selects, from the shoe list, a shoe model to consider purchasing (S32), a product detail page of the selected shoe is displayed (S34). On the product detail page of the shoe, an image and detailed information of the shoe is presented, and shoe size options are also displayed. When the user has already logged in to the shoe sales site (Y at S36) and when measurement values of the user's foot have been measured and stored in the shoe fit evaluation server 50 in advance (Y at S38), the processes from S39 to S48 are performed. That is, the last selector 71 selects, as evaluation targets, one or more lasts of which the last foot length is close to the user's foot length, from among lasts of multiple types of shoe sizes corresponding to a shoe model that the user is considering purchasing (S39). The dimensional difference calculation unit 72 recognizes the measurement method used for the measurement of the foot part dimensions of the user (S40) and adjusts the measurement values of the foot part dimensions for error correction depending on the measurement method (S42). The dimensional difference calculation unit 72 adjusts the part dimensional difference according to the characteristics of each part (S44), and the evaluation processing unit 74 calculates the last matching rate based on the part dimensional difference (S46). The recommendation output unit 82 displays a shoe size of which the last matching rate is highest, and the last matching rate (S48).

When the user has not logged in to the shoe sales site (N at S36) or when measurement values of the foot have not been measured in advance (N at S38), the processes from S39 to S48 are skipped. In the example described above, when the user has already logged in, the user selects a shoe model from a shoe list, as in S32, and a shoe size of which the last matching rate is high and the last matching rate are then displayed on the product detail page of the shoe. In a modification, the last matching rate for each shoe model can be calculated as shown in S36 to S48 prior to the display of a shoe list at S32; at the stage of the display of a shoe list at S32, a shoe size of which the last matching rate is high and the last matching rate can be displayed for each shoe model.

Figure 9:
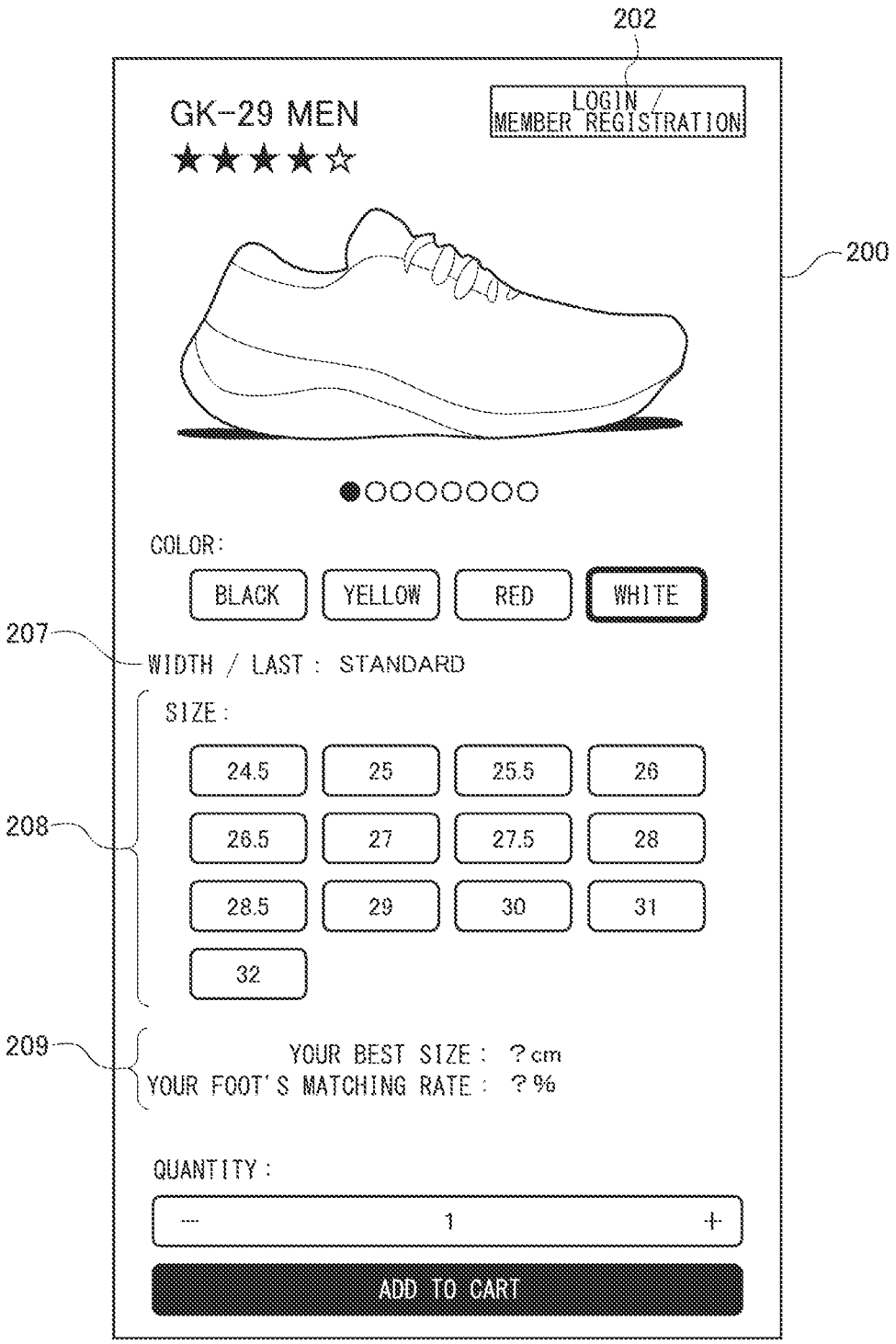
FIG. 9 illustrates a screen example for a first product detail page in the second embodiment.

FIG. 9 illustrates a screen example for a first product detail page in the second embodiment. The first product detail page is a product detail page displayed when the user is not logged in to the product sales site. On a screen 200, detailed information of a shoe is displayed, and a link button 202 showing "LOGIN/MEMBER REGISTRATION" is also displayed at the upper right of the screen 200. The link button 202 is linked to a page for login or member registration and indicates that the user viewing the product detail page has not yet logged in or signed up as a member. When the user presses the link button 202, the screen shifts to the page for login or member registration.

On the first product detail page, besides the product name, a product image, and detailed description, evaluation information for the product is also displayed on the screen 200. As shoe color options, multiple color selection buttons are displayed. When one of the color selection buttons is pressed, the pressed selection button is highlighted as a selected state, and a shoe image of the selected color is displayed. Also, the type of the width size of the displayed shoe is displayed in a width size display column 207.

In a shoe size selection column 208, multiple size buttons are displayed as multiple shoe size options. When one of the size selection buttons is pressed, the pressed selection button is highlighted as a selected state. A size recommendation column 209 is a column in which a shoe size suitable for the user's foot and the last matching rate thereof are displayed. However, since the measurement values of a foot of a user who is not logged in are unknown, the shoe size suitable for the user's foot and the last matching rate thereof are not displayed.

Figure 10:
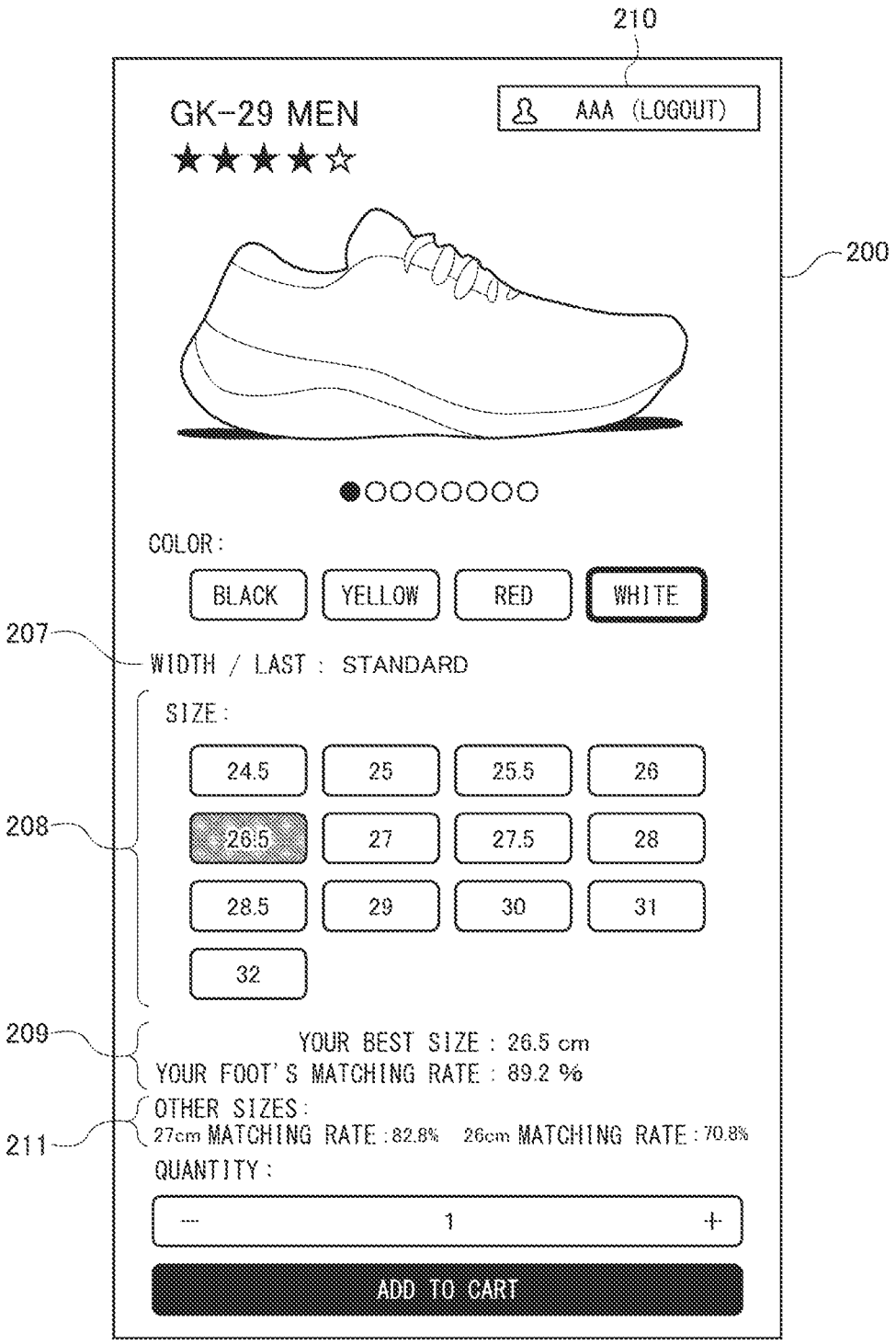
FIG. 10 illustrates a screen example for a second product detail page in the second embodiment.

FIG. 10 illustrates a screen example for a second product detail page in the second embodiment. The second product detail page is a product detail page displayed when the user has already logged in to the product sales site. As with the screen 200 of the first product detail page shown in FIG. 9, the screen 200 displays the detailed information of a shoe. However, at the upper right of the screen 200, the link button 202 is not displayed, but instead a link button 210 showing the user name and the character string "LOGOUT" is displayed. The link button 210 is linked to a page for logout and indicates that the user viewing the product detail page has already logged in.

When the user has already logged in, the last matching rate is calculated with the measurement values of the user's foot based on the part dimensional difference between the user's foot and lasts of multiple shoe sizes. When the shoe size with the highest last matching rate is "26.5 cm", for example, the selection button indicating "26.5 cm" is displayed in a different color from the other buttons in the shoe size selection column 208, suggesting that it is most suitable for the user's foot. In the size recommendation column 209, character strings are displayed to indicate that the shoe size most suitable for the user's foot is "26.5 cm" and that the last matching rate is "89.2%". Also, in an other size information column 211 displayed below the size recommendation column 209, the last matching rates for the shoe sizes one size larger and one size smaller are displayed as information regarding other shoe sizes.

Figure 11:
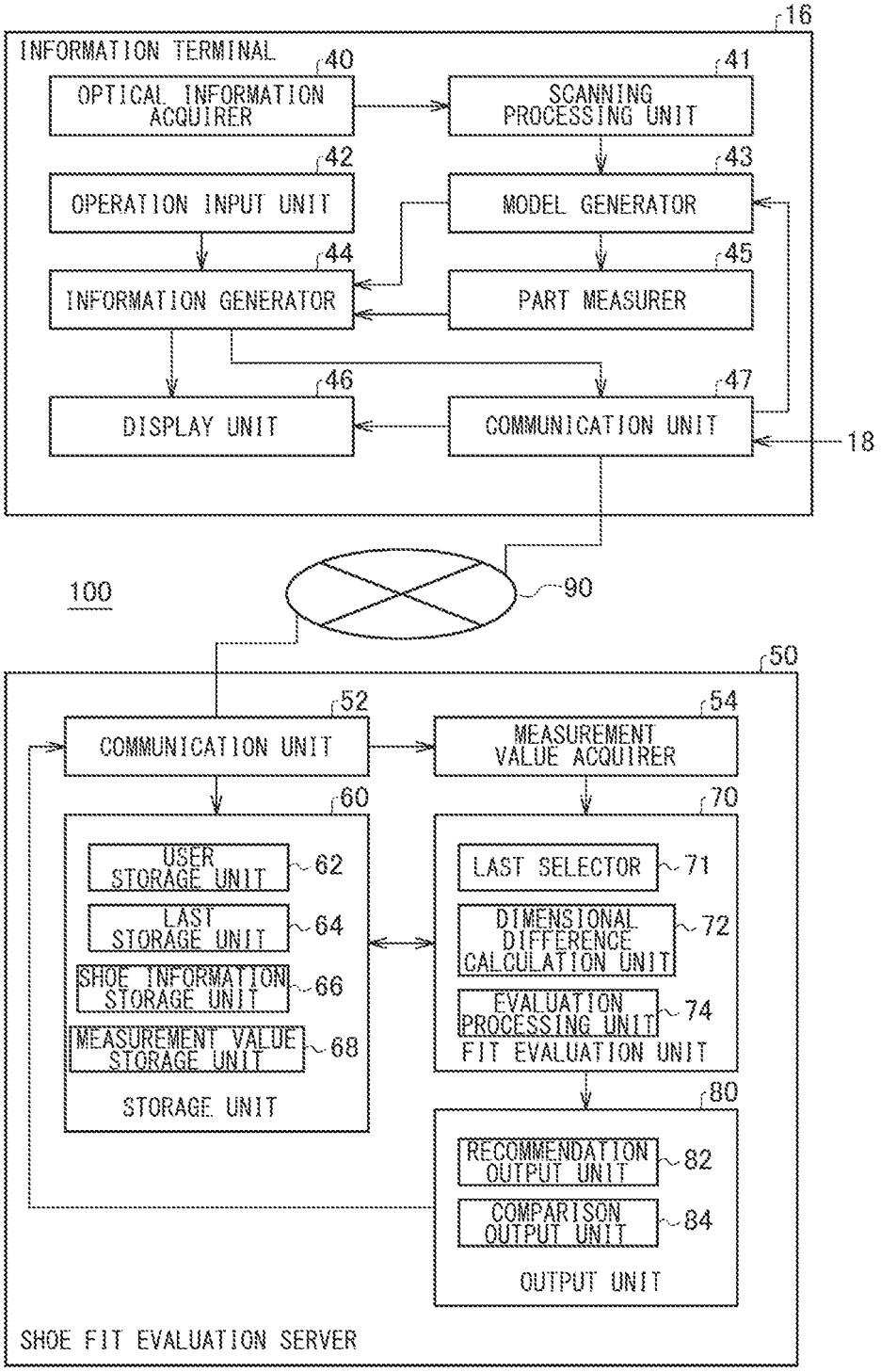
FIG. 11 is a functional block diagram that shows each configuration in the shoe fit evaluation system in the second embodiment.

FIG. 11 is a functional block diagram that shows each configuration in the shoe fit evaluation system 100 in the second embodiment. The storage unit 60 in the second embodiment further includes a measurement value storage unit 68 in which measurement values of multiple foot part dimensions acquired from the information terminal 16 are stored in association with the identification information of the measurement subject 10.

The last selector 71 selects, as an evaluation target, one or more lasts corresponding to a shoe model selected by the user, from among multiple types of lasts stored in the last storage unit 64. Based on the measurement values of the user's foot dimensions, the last selector 71 selects one or more lasts as evaluation targets, from among lasts of shoe sizes and width sizes that can be worn with a foot of the foot dimensions and lasts of which sizes approximate the foot dimensions. The lasts are designed and stored respectively for multiple sizes of multiple models. The multiple sizes include multiple shoe sizes as the sizes in the foot length directions, and multiple width sizes as the sizes in the foot width directions. One or more width sizes are designed for one shoe size. Whether or not multiple width sizes are designed for one shoe size depends on the shoe model.

With regard to a last selected by the last selector 71, the dimensional difference calculation unit 72 calculates a part dimensional difference, which is a difference between the measurement value of a foot part dimension and a last part dimension corresponding to the foot part, in which a predetermined adjustment for the part is made. The evaluation processing unit 74 calculates the last matching rate based on the part dimensional difference for the last selected by the last selector 71. In the following, methods for calculating the part dimensional difference and the last matching rate in the second embodiment will be detailed.

The "predetermined adjustment" includes the following four calculations as in the first embodiment. That is, in the calculation of the part dimensional difference, there are an adjustment to subtract an allowance for the specific stretch properties of each part of a shoe upper (Adjustment 1), an adjustment to calculate the part dimensional difference as the sum of the squares of part dimensional differences in which the specific weights of the respective parts are added (Adjustment 2), an adjustment to calculate the sum of the squares of part dimensional differences in which a first weight is added to the part dimensional difference of the foot length and a second weight, which is smaller than the first weight, is added to the part dimensional difference of a part other than the foot length (Adjustment 3), and an adjustment to use, as a measurement value of a foot part dimension, a value obtained by adding, to the actual measured value of the foot part dimension, an error correction depending on the measurement method (Adjustment 4). The method for calculating the last matching rate with these adjustments added is given by the following equation.

$$\text{Last } fit \text{ rate} = 100 - \text{part dimensional difference}$$

The "specific stretch properties of each part" as used herein mean the properties of the shoe upper's stretching and contracting. The upper is made of mesh or artificial leather, for example, and the rigidity is different in each part. Accordingly, the stretch properties of each part based on the materials and structure of the upper are taken into consideration in the calculation of the part dimensional difference. Even two shoes manufactured with the same last will differ in stretch properties if the materials or structures of their uppers are different. Therefore. Adjustment 1 can be performed depending on the difference in stretch properties, as necessary.

Also, with regard to the "specific weights", since the rigidity distribution in the shoe upper is not necessarily constant for each shoe model, the specific weights are used to weight the calculated values, as Adjustment 2, in order to adjust the influence of each part on the last matching rate.

In the second embodiment, among the predetermined adjustments (Adjustments 1 to 4) for foot parts in the calculation of the part dimensional difference. Adjustment 4 using a value obtained by adding an error correction depending on the measurement method can be performed in advance, and the adjusted values after Adjustment 4 can be stored as the measurement values of the foot part dimensions of the user in the measurement value storage unit 68. In that case, since Adjustment 4 has already been performed on the measurement values stored in the measurement value storage unit 68, Adjustment 4 is not performed when a last suitable for the user's foot is evaluated for a shoe model selected by the user.

In the second embodiment, the dimensional difference calculation unit 72 and the evaluation processing unit 74 calculate a size score and a width score to calculate the last matching rate based on the part dimensional difference. The part dimensional difference is the sum of the squares of the size score based mainly on the foot length dimensional difference and the width score based mainly on the ball girth dimensional difference and is given by the following equation.

$$\text{Part dimensional difference} = \alpha \times \text{size score} + \beta \times \text{width score}$$

In the equation, "a" is a weighting factor by which the size score is multiplied and corresponds to the "first weight" in the first embodiment and the claims. Also, "P" is a weighting factor by which the width score is multiplied and corresponds to the "second weight" in the first embodiment and the claims. The size score substantially corresponds to the "foot length score" in the first embodiment. Also, the width score substantially corresponds to the "ball girth score" in the first embodiment.

The size score is a value calculated based on the measurement results of the foot length, heel width, short heel girth, and toe shape and is given by the following equation.

$$\text{Size score} = (\text{last foot length} - \text{foot length measurement value} - \text{adjustment value } d1 + \text{correction value } C1)\hat{}2$$

The adjustment value d1 is an adjustment value used when Adjustment 1 is applied to the foot length dimensional difference, similarly to Adjustment 1 in the first embodiment. The adjustment value d1 is an allowance subtracted from the foot length dimensional difference, based on the specific stretch properties of each shoe part.

The correction value C1 corresponds to the "size up adjustment value" described in the first embodiment and is one of (1) a correction value based on the heel width ratio, (2) a correction value based on a short heel girth ratio, or (3) a correction value based on the toe shape, or a value obtained by adding these correction values. The correction value C1 is a variable value, at which a different value is set also depending on the width type of a last as an evaluation target for the part dimensional difference. The "heel width ratio" is a ratio of the heel width to the foot length, i.e., heel width ratio=heel width/foot length, and is usually around ⅓ to ¼. The "short heel girth ratio" is a ratio of the short heel girth to the foot length, i.e., short heel girth ratio=short heel girth/foot length, and is usually a ratio of 100% or higher.

(1) The foot length dimensional difference is adjusted based on the heel width ratio because, since the heel of a foot with a larger heel width ratio is more difficult to fit into a heel portion of a shoe, the entire foot shifts toward the toe, so that the shoe is likely to be tight at the toe. (2) The foot length dimensional difference is adjusted based on the short heel girth ratio because, as with the heel width ratio, since the heel of a foot with a larger short heel girth ratio is more difficult to fit into a heel portion of a shoe, the entire foot shifts toward the toe, so that the shoe is likely to be tight at the toe. (3) The foot length dimensional difference is adjusted based on the toe shape because, especially when the toe shape is a square type, the fourth and fifth toes are difficult to fit into a toe portion of a shoe. The toe shape includes a round type characterized by a long second toe, an oblique type characterized by a long first toe, and a square type characterized by little difference in toe length. The square type is particularly common in children's feet. The type of toe shape can be determined by evaluating the ratio of the length or tip position of each of the first to fifth toes to the foot length.

Since (1) the correction value based on the heel width ratio and (2) the correction value based on the short heel girth ratio have a feature in common of having the reason for adjustment of the fit of the heel, there is no need to perform the adjustment doubly, and the larger correction value is preferentially used for the adjustment. Meanwhile, (3) the correction value based on the toe shape is not used for adjustment for the fit of the heel. Therefore, the adjustment can be doubly performed such as (1)+(3) or (2)+(3).

The width types of lasts are provided by classifying the shoe size in a foot width direction into types, which are a first type, a second type, a third type, and a fourth type in the second embodiment. The first type is "Narrow", which is a type with a narrower foot width than Standard. The second type is "Standard" with a standard foot width. The third type is "Wide", which is a type with a wider foot width than Standard. The fourth type is "Extra Wide", which is a type with a wider foot width than Wide.

The correction value C1 is set based on different criteria depending on which of the first to fourth types the width type of the last is. Also, as described above, a different value is set as the correction value C1 depending on the heel width ratio, short heel girth ratio, and toe shape. When the heel width ratio is a predetermined heel width reference value RW or greater, one of correction values CW1 to CW3, which are variable values that increase in proportion to the heel width ratio, can be set. More specifically, as the correction value C1, the correction value CW1 can be set when the width type is the first type, the correction value CW2 can be set when the width type is the second or third type, and the correction value CW3 can be set when the width type is the fourth type. When the short heel girth ratio is a predetermined short heel girth reference value RG or greater and when the width type is one of the second to fourth types, a correction value CG, which is a fixed value, can be set as the correction value C1. However, when the heel width ratio is the heel width reference value RW or greater and when the short heel girth ratio is the short heel girth reference value RG or greater, the greater value of the correction values CW1 to CW3 and the correction value CG can be set as the correction value C1. Furthermore, when the width type of the last is one of the second to fourth types and when the toe shape in the foot shape is the square type, a correction value CT is added to the correction value C1.

Figure 12:
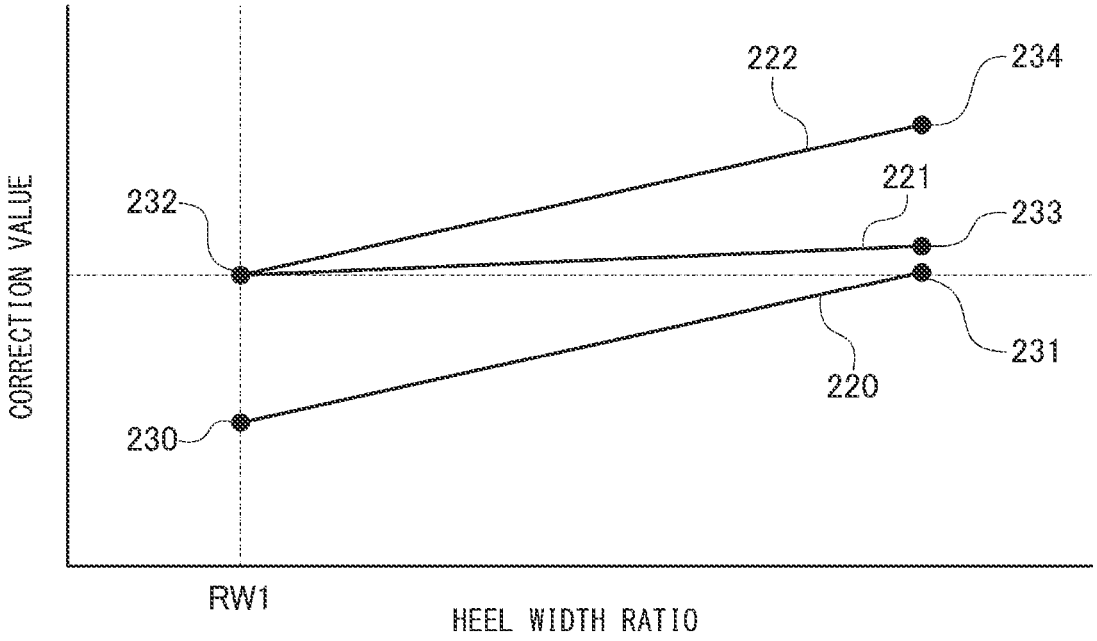
FIG. 12 shows the relationship between a heel width ratio and a correction value for each width type in the second embodiment.

FIG. 12 shows the relationship between the heel width ratio and the correction value for each width type in the second embodiment. In the three lines drawn in the graph of FIG. 12, from the bottom, a first line 220 indicates the first type as the width type, a second line 221 indicates the second or third type as the width type, and a third line 222 indicates the fourth type as the width type.

The first line 220 indicates the case where the width type of a last as an evaluation target is the first type, i.e., narrower than Standard, and, when the heel width ratio of the foot shape is the predetermined heel width reference value RW or greater, the correction value CW1 is set as the correction value C1. The correction value CW1 is a value that increases in proportion to the heel width ratio, in the range from a first correction value 230 to a second correction value 231. When the heel width ratio of the foot shape is less than the predetermined heel width reference value RW, adjustment with the correction value C1 is not performed, or the correction value C1 is set to 0.

The second line 221 indicates the case where the width type of a last as an evaluation target is the second or third type, i.e., Standard or Wide, and, when the heel width ratio of the foot shape is the predetermined heel width reference value RW or greater, the correction value CW2 is set as the correction value C1. The correction value CW2 is a value that increases in proportion to the heel width ratio, in the range from a third correction value 232 to a fourth correction value 233. The increase rate of the correction value CW2 proportional to the heel width ratio in the second line 221 is smaller than the increase rates of the correction values CW1 and CW3 proportional to the heel width ratio in the first line 220 and the third line 222.

The third line 222 indicates the case where the width type of a last as an evaluation target is the fourth type, i.e., Extra Wide or wider, and, when the heel width ratio of the foot shape is the predetermined heel width reference value RW or greater, the correction value CW3 is set as the correction value C1. The correction value CW3 is a value that increases in proportion to the heel width ratio, in the range from the third correction value 232 to a fifth correction value 234.

The second correction value 231, which is the upper limit value of the correction value in the first line 220, and the third correction value 232, which is the lower limit value of the correction value in the second line 221 and the third line 222, can be the same value, which can be a value corresponding to a difference of one size in the shoe size.

Also, although the correction values CW1 to CW3 based on the heel width ratio are variable values, the correction value CG based on the short heel girth ratio can be a fixed value. The value of the correction value CG based on the short heel girth ratio can be a value corresponding to a difference of one size in the shoe size. The value of the correction value CG based on the short heel girth ratio can also be the same value as the second correction value 231, which is the upper limit value of the correction value CW1 in the first line 220. The value of the correction value CG based on the short heel girth ratio can also be the same value as the third correction value 232, which is the lower limit value of the correction values CW2 and CW3 in the second line 221 and third line 222.

Figure 13:
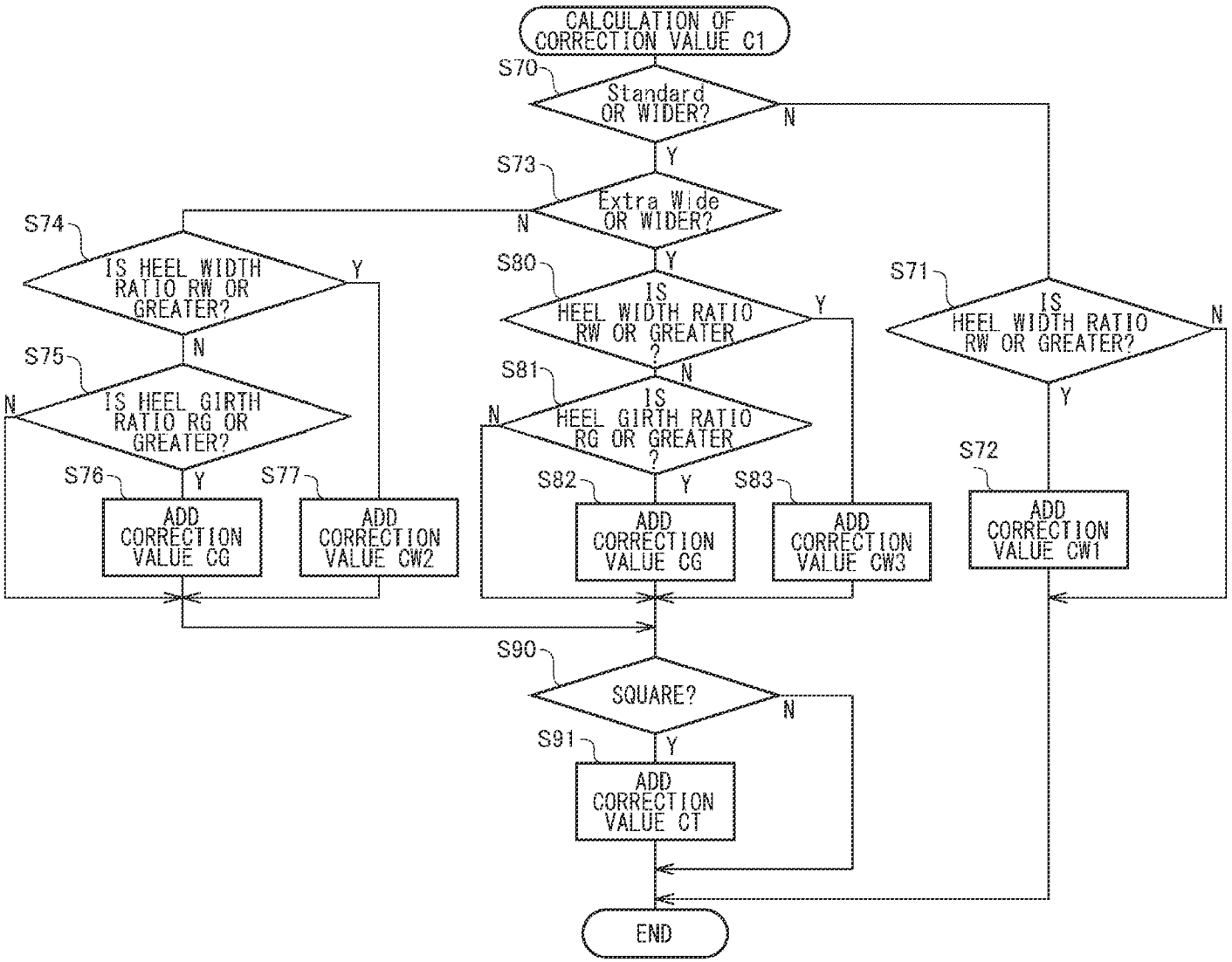
FIG. 13 is a flowchart that shows an algorithm for calculating a correction value C1.

FIG. 13 is a flowchart that shows an algorithm for calculating the correction value C1. When the width type of a last as an evaluation target is not equal to or wider than Standard, i.e., when it is the first type narrower than Standard, the process proceeds to S71 (N at S70). At S71, when the heel width ratio of the foot shape is the heel width reference value RW or greater (Y at S71), the correction value CW1 as a variable value based on the heel width ratio, in the range from the first correction value 230 to the second correction value 231, is set as the correction value C1 (S72), and the calculation flow is terminated. When the heel width ratio is not equal to or greater than the heel width reference value RW (N at S71), the process of S72 is skipped, and the calculation flow is terminated with the correction value C1 remaining at 0.

When the width type of a last as an evaluation target is Standard or wider (Y at S70) and narrower than Extra Wide (N at S73), i.e., when it is the second or third type, the process proceeds to S74. At S74, when the heel width ratio of the foot shape is the heel width reference value RW or greater (Y at S74), the correction value CW2 as a variable value based on the heel width ratio, in the range from the third correction value 232 to the fourth correction value 233, is set as the correction value C1 (S77), and the process proceeds to S90. When the heel width ratio of the foot shape is not equal to or greater than the heel width reference value RW (N at S74) and when the short heel girth ratio of the foot shape is the short heel girth reference value RG or greater (Y at S75), the correction value CG as a fixed value based on the short heel girth ratio is set as the correction value C1 (S76), and the process proceeds to S90. When the short heel girth ratio of the foot shape is not equal to or greater than the short heel girth reference value RG (N at S75), the process of S76 is skipped, and the process proceeds to S90. When the heel width ratio of the foot shape is the heel width reference value RW or greater (Y at S74), since the correction value CG based on the short heel girth ratio is not greater than the correction value CW2, the processes of S75 and S76 are skipped.

When the width type of a last as an evaluation target is Standard or wider (Y at S70) and when it is Extra Wide or wider (Y at S73), i.e., when it is the fourth type, the process proceeds to S80. At S80, when the heel width ratio of the foot shape is the heel width reference value RW or greater (Y at S80), the correction value CW3 as a variable value based on the heel width ratio, in the range from the third correction value 232 to the fifth correction value 234, is set as the correction value C1 (S83), and the process proceeds to S90. When the heel width ratio of the foot shape is not equal to or greater than the heel width reference value RW (N at S80) and when the short heel girth ratio of the foot shape is the short heel girth reference value RG or greater (Y at S81), the correction value CG as a fixed value based on the short heel girth ratio is set as the correction value C1 (S82), and the process proceeds to S90. When the short heel girth ratio of the foot shape is not equal to or greater than the short heel girth reference value RG (N at S81), the process of S82 is skipped, and the process proceeds to S90. When the heel width ratio of the foot shape is the heel width reference value RW or greater (Y at S80), since the correction value CG based on the short heel girth ratio is not greater than the correction value CW3, the processes of S81 and S82 are skipped.

At S90, i.e., after the correction value is calculated when the width type of the last is Standard or wider, when the toe shape is the square type (Y at S90), the correction value CT as a fixed value is added to the correction value C1 (S91), and the calculation flow is terminated. When the toe shape is not the square type (N at S90), the process of S91 is skipped, and the calculation flow is terminated.

The width score is a value calculated based on the measurement results of the ball girth and instep girth and is given by the following equation.

Width score=(last ball girth−ball girth measurement value−*d*2)^2

The "ball girth measurement value" in the above width score calculation equation is set based on predetermined criteria depending on a ball girth ratio or a instep girth ratio. The "ball girth ratio" is a ratio of the ball girth to the foot length, i.e., ball girth ratio=ball girth/foot length. The "instep girth ratio" is a ratio of the instep girth to the foot length, i.e., instep girth ratio=instep girth/foot length. When the difference between the ball girth and the instep girth is within a predetermined range, the width score is calculated using the above calculation equation. When the instep girth is greater than the ball girth by more than a criterion, the width score is calculated using the instep girth instead of the ball girth. When the ball girth is greater than the instep girth by more than a criterion, the width score is calculated using an average of the ball girth and the instep girth. In the following, a more specific calculation equation will be described.

When the ball girth is greater than the instep girth and when the difference between the ball girth ratio and the instep girth ratio is within a predetermined reference range, such as smaller than or equal to a predetermined reference value RD1 and larger than or equal to a predetermined reference value RD2, where RD2 is a negative value, the following equation is used as with the width score calculation equation described above.

Width score=(last ball girth−ball girth measurement value−*d*2)^2

Meanwhile, when the instep girth is greater than the ball girth and when the "ball girth ratio−the instep girth ratio" is smaller than the predetermined reference range, i.e., smaller than the predetermined reference value RD2, where RD2 is a negative value, since the instep girth is greater than the ball girth by more than a criterion, the instep girth measurement value is used to calculate the width score. In this case, the width score calculation equation is given by the following equation.

Width score=(last instep girth−instep girth measurement value−*d*2)^2

Thus, for a person who has the instep girth larger than the ball girth, the width score is evaluated based on the instep girth, so that the last matching rate can be calculated more accurately.

When the ball girth is greater than the instep girth and when the difference between the ball girth ratio and the instep girth ratio is larger than the predetermined reference range, i.e., larger than the predetermined reference value RD1, an average value of the ball girth measurement value and the instep girth measurement value is used to calculate the width score. In this case, the width score calculation equation is given by the following equation.

Width score=((average of last ball girth and last instep girth)−(average of ball girth measurement value and instep girth measurement value)−$d2$)^2

In a last, the ball girth and the instep girth are almost proportional and there is almost no difference between them. Therefore, whether to use the ball girth or the instep girth as a girth length causes no significant difference. This is because lasts are designed so that the ball girth and the instep girth are proportional. On the other hand, the actual relationship between the ball girth and the instep girth acquired from multiple measurement subjects varies greatly among them, with some people having larger ball girth and others having larger instep girth. The difference also varies from person to person. In order to calculate the width score more appropriately considering such individual differences, the value used as the ball girth measurement value is determined based on the difference between the ball girth and the instep girth.

The present disclosure has been described with reference to embodiments. The embodiments are intended to be illustrative only, and it will be obvious to those skilled in the art that various modifications to a combination of constituting elements or processes could be developed and that such modifications also fall within the scope of the present disclosure. Also, when the embodiments set forth above are generalized, the following aspects are obtained.

Aspect 1

A shoe fit evaluation device, including:

a measurement value acquirer that acquires measurement values of a plurality of foot part dimensions, which are dimensions of a plurality of foot parts including at least a foot length, as foot shape dimension information that defines a foot shape of a measurement subject;

a last storage unit that stores, for each of a plurality of types of lasts, a plurality of last part dimensions, which are dimensions of last parts corresponding to a plurality of foot parts including at least the foot length, as last dimension information that defines a last;

a dimensional difference calculation unit that calculates a part dimensional difference, which is a difference between a measurement value of a foot part dimension and a last part dimension corresponding to the foot part, by performing a predetermined adjustment for the part;

an evaluation processing unit that calculates a last matching rate based on the part dimensional difference; and an output unit that outputs information regarding the last matching rate.

Aspect 2

The shoe fit evaluation device according to Aspect 1, wherein the dimensional difference calculation unit calculates the part dimensional difference by performing, as the predetermined adjustment, subtraction of an allowance for specific stretch properties of each shoe part.

Aspect 3

The shoe fit evaluation device according to Aspect 1 or 2, wherein the dimensional difference calculation unit performs, as the predetermined adjustment, calculation of the sum of the squares of part dimensional differences in which specific weights of the respective parts are added.

Aspect 4

The shoe fit evaluation device according to any one of Aspects 1 through 3, wherein the dimensional difference calculation unit performs, as the predetermined adjustment, calculation of the sum of the squares of part dimensional differences in which a first weight is added to the part dimensional difference of the foot length and a second weight, which is smaller than the first weight, is added to the part dimensional difference of a part other than the foot length.

Aspect 5

The shoe fit evaluation device according to any one of Aspects 1 through 4, wherein the dimensional difference calculation unit performs, as the predetermined adjustment, using, as a measurement value of the foot part dimension, a value obtained by adding an error correction depending on the measurement method to an actual measured value of the foot part dimension.

Aspect 6

The shoe fit evaluation device according to any one of Aspects 1 through 4, wherein the dimensional difference calculation unit performs, as the predetermined adjustment, using, as a measurement value of the foot part dimension, a value obtained by adding an error correction depending on the measurement method to an actual measured value of the foot part dimension.

Aspect 7

The shoe fit evaluation device according to any one of Aspects 1 through 6, wherein the dimensional difference calculation unit calculates the part dimensional difference by performing, as the predetermined adjustment, addition of a correction value based on a heel width ratio with respect to the foot length.

Aspect 8

The shoe fit evaluation device according to any one of Aspects 1 through 6, wherein the dimensional difference calculation unit calculates the part dimensional difference by performing, as the predetermined adjustment, addition of a correction value based on a short heel girth ratio with respect to the foot length when the ball girth is a predetermined criterion or greater.

Aspect 9

The shoe fit evaluation device according to any one of Aspects 1 through 8, wherein the dimensional difference calculation unit calculates the part dimensional difference by performing, as the predetermined adjustment, addition of the greater correction value of a correction value based on the heel width ratio with respect to the foot length and a correction value based on the short heel girth ratio with respect to the foot length, when the ball girth is a predetermined criterion or greater.

Aspect 10

The shoe fit evaluation device according to any one of Aspects 1 through 9, wherein the dimensional difference calculation unit calculates the part dimensional difference with regard to the foot length dimension by performing, as the predetermined adjustment, addition of a correction value based on a toe shape type of a foot shape of the measurement subject.

Aspect 11

The shoe fit evaluation device according to any one of Aspects 1 through 10, wherein, with regard to the foot width dimension, the dimensional difference calculation unit calculates: the part dimensional difference of the instep girth when the difference between the ball girth ratio with respect to the foot length and the instep girth ratio with respect to the foot length is smaller than a predetermined reference range; the part dimensional difference of an average value of the ball girth and the instep girth when the difference between the ball girth ratio with respect to the foot length and the instep girth ratio with respect to the foot length is larger than the predetermined reference range; and the part dimensional difference of the ball girth when the difference between the ball girth ratio with respect to the foot length and the instep girth ratio with respect to the foot length is within the predetermined reference range.

Aspect 12

The shoe fit evaluation device according to any one of Aspects 1 through 11, wherein the evaluation processing unit calculates the last matching rate for each of a plurality of types of lasts and selects at least one shoe corresponding to a last of which the last matching rate is relatively high, from among a plurality of shoe options and wherein the output unit outputs information that indicates the selected shoe and the last matching rate of the last of the selected shoe.

Aspect 13

The shoe fit evaluation device according to any one of Aspects 1 through 12, wherein the evaluation processing unit calculates the last matching rate for each of a plurality of types of lasts and selects at least one shoe corresponding to a last of which the last matching rate is relatively high, from among a plurality of shoe options and wherein the output unit outputs information that visually indicates a comparison result between a last part dimension of the selected shoe and a foot part dimension.

Aspect 14

The shoe fit evaluation device according to any one of Aspects 1 through 13, further including a measurement value storage unit that stores measurement values of the plurality of foot part dimensions in association with identification information of the measurement subject, wherein the dimensional difference calculation unit calculates the part dimensional difference from a last of shoe type selected by the measurement subject, wherein the evaluation processing unit calculates the last matching rate with respect to a last of shoe type selected by the measurement subject, and wherein the output unit outputs information that indicates a shoe type selected by the measurement subject, information that indicates at least one of a foot length direction dimension or a foot width direction dimension of a shoe of the shoe type having a relatively high last matching rate based on a measurement value of the measurement subject, and information that indicates the last matching rate.

Aspect 15

A shoe fit evaluation method, including:

acquiring measurement values of a plurality of foot part dimensions, which are dimensions of a plurality of foot parts including at least a foot length, as foot shape dimension information that defines a foot shape of a measurement subject;

retrieving, from a predetermined storage means, a plurality of last part dimensions, which are dimensions of last parts corresponding to a plurality of foot parts including at least the foot length, as last dimension information that defines a last;

calculating a part dimensional difference, which is a difference between a measurement value of a foot part dimension and a last part dimension corresponding to the foot part, by performing a predetermined adjustment for the part;

calculating a last matching rate based on the part dimensional difference; and outputting information regarding the last matching rate.

What is claimed is:

1. A shoe fit evaluation device, comprising:

a three-dimensional foot shape measuring device or measurement mat configured to receive a foot of a measurement subject and be used to acquire three-dimensional data regarding a foot shape of the foot;

a measurement value acquirer configured to acquire measurement values of a plurality of foot part dimensions based on the three-dimensional data regarding the foot shape, which are dimensions of a plurality of foot parts including at least a foot length, as foot shape dimension information that defines the foot shape of the measurement subject;

a last storage configured to store, for each of a plurality of types of lasts, a plurality of last part dimensions, which are dimensions of last parts corresponding to the plurality of foot parts including at least the foot length, as last dimension information that defines a last;

a dimensional difference calculator configured to calculate a part dimensional difference, which is a difference between a measurement value of a foot part dimension of the plurality of foot part dimensions and a last part dimension of the plurality of last part dimensions corresponding to a foot part of the plurality of foot parts, by performing a predetermined adjustment for the foot part;

an evaluation processor configured to calculate a last matching rate based on the part dimensional difference; and an outputter configured to output information regarding the last matching rate.

2. The shoe fit evaluation device according to claim 1, wherein the dimensional difference calculator is configured to calculate the part dimensional difference by performing, as the predetermined adjustment, subtraction of an allowance for specific stretch properties of each shoe part.

3. The shoe fit evaluation device according to claim 1, wherein the part dimensional difference is one of a plurality of part dimensional differences, and the dimensional difference calculator is configured to perform, as the predetermined adjustment, a calculation of a sum of squares of the part dimensional differences in which specific weights of respective parts are added.

4. The shoe fit evaluation device according to claim 2, wherein the part dimensional difference is one of a plurality of part dimensional differences, and the dimensional difference calculator is configured to perform, as the predetermined adjustment, a calculation of a sum of squares of the part dimensional differences in which specific weights of respective parts are added.

5. The shoe fit evaluation device according to claim 1, wherein the part dimensional difference is a first part dimensional difference of a plurality of part dimensional differences, and the dimensional difference calculator is configured to perform, as the predetermined adjustment, calculation of a sum of squares of the part dimensional differences in which a first weight is added to the first part dimensional difference, which is of the foot length and a second weight, which is smaller than the first weight, is added to a second part dimensional difference of a foot part other than the foot length.

6. The shoe fit evaluation device according to claim 2, wherein the part dimensional difference is a first part dimensional difference of a plurality of part dimensional differences, and the dimensional difference calculator is configured to perform, as the predetermined adjustment, calculation of a sum of the squares of the part dimensional differences in which a first weight is added to the first part dimensional difference, which is of the foot length and a second weight, which is smaller than the first weight, is added to a second part dimensional difference of a foot part other than the foot length.

7. The shoe fit evaluation device according to claim 1, wherein the dimensional difference calculator is configured to perform, as the predetermined adjustment, using, as the measurement value of the foot part dimension, a value obtained by adding an error correction depending on the measurement method to an actual measured value of the foot part dimension.

8. The shoe fit evaluation device according to claim 2, wherein the dimensional difference calculator is configured to perform, as the predetermined adjustment, using, as the measurement value of the foot part dimension, a value obtained by adding an error correction depending on the measurement method to an actual measured value of the foot part dimension.

9. The shoe fit evaluation device according to claim 1, wherein the plurality of foot parts are a combination of at least one of a ball girth, a heel width, an instep girth, or a short heel girth and the foot length.

10. The shoe fit evaluation device according to claim 1, wherein the dimensional difference calculator is configured to calculate the part dimensional difference by performing, as the predetermined adjustment, addition of a correction value based on a heel width ratio with respect to the foot length.

11. The shoe fit evaluation device according to claim 1, wherein the dimensional difference calculator is configured to calculate the part dimensional difference by performing, as the predetermined adjustment, addition of a correction value based on a short heel girth ratio with respect to the foot length when a ball girth is a predetermined criterion or greater.

12. The shoe fit evaluation device according to claim 1, wherein the dimensional difference calculator is configured to calculate the part dimensional difference by performing, as the predetermined adjustment, addition of the greater correction value of a correction value based on a heel width ratio with respect to the foot length and a correction value based on a short heel girth ratio with respect to the foot length, when a ball girth is a predetermined criterion or greater.

13. The shoe fit evaluation device according to claim 1, wherein the dimensional difference calculator is configured to calculate the part dimensional difference with regard to the foot length dimension by performing, as the predetermined adjustment, addition of a correction value based on a toe shape type of the foot shape of the measurement subject.

14. The shoe fit evaluation device according to claim 1, wherein, with regard to a foot width dimension, the dimensional difference calculator is configured to calculate the part dimensional difference of an instep girth when a difference between a ball girth ratio with respect to the foot length and an instep girth ratio with respect to the foot length is smaller than a predetermined reference range, the part dimensional difference of an average value of a ball girth and the instep girth when a difference between the ball girth ratio with respect to the foot length and the instep girth ratio with respect to the foot length is larger than the predetermined reference range, and the part dimensional difference of the ball girth when the difference between the ball girth ratio with respect to the foot length and the instep girth ratio with respect to the foot length is within the predetermined reference range.

15. The shoe fit evaluation device according to claim 1, wherein the evaluation processor is configured to calculate the last matching rate for each of the plurality of types of lasts and select at least one shoe corresponding to a last of the plurality of types of lasts of which the last matching rate is relatively high, from among a plurality of shoe options, and the outputter is configured to output information indicating the at least one shoe selected and the last matching rate of the last of the at least one shoe selected.

16. The shoe fit evaluation device according to claim 1, wherein the evaluation processor is configured to calculate the last matching rate for each of the plurality of types of lasts and select at least one shoe corresponding to a last of the plurality of types of lasts of which the last matching rate is relatively high, from among a plurality of shoe options, and wherein the outputter is configured to output information visually indicating a comparison result between a last part dimension of the at least one shoe selected and a foot part dimension.

17. The shoe fit evaluation device according to claim 1, further comprising a measurement value storage configured to store measurement values of the plurality of foot part dimensions in association with identification information of the measurement subject, the dimensional difference calculator configured to calculate the part dimensional difference from a last of the plurality of types of lasts of a shoe type selected by the measurement subject, the evaluation processor configured to calculate the last matching rate with respect to the last of shoe type selected by the measurement subject, and the outputter configured to output information indicating the shoe type selected by the measurement subject, the information indicating at least one of a foot length direction dimension or a foot width direction dimension of a shoe of the shoe type having a relatively high last matching rate based on a measurement value of the measurement subject, and information indicating the last matching rate.

18. A shoe fit evaluation method, comprising:

receiving a foot of a measurement subject and acquiring three-dimensional data regarding a foot shape of the foot using a three-dimensional foot shape measuring device or a measurement mat;

acquiring measurement values of a plurality of foot part dimensions based on the three-dimensional data regarding the foot shape, the plurality of foot part dimensions being dimensions of a plurality of foot parts including at least a foot length, as foot shape dimension information defining the foot shape of the measurement subject;

retrieving, from a predetermined storage device, a plurality of last part dimensions, the plurality of last part dimensions being dimensions of last parts corresponding to a plurality of foot parts including at least the foot length, as last dimension information defining a last;

calculating a part dimensional difference, the part dimensional difference being a difference between a measurement value of a foot part dimension and a last part dimension corresponding to the foot part, by performing a predetermined adjustment for the foot part;

calculating a last matching rate based on the part dimensional difference; and outputting information regarding the last matching rate.

* * * * *